US007014548B1

(12) United States Patent
Lin

(10) Patent No.: US 7,014,548 B1
(45) Date of Patent: Mar. 21, 2006

(54) PNEUMATIC GRINDER WITH EASILY REPLACING GRINDING DISC

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 11/195,704

(22) Filed: Aug. 3, 2005

Related U.S. Application Data

(63) Continuation-in-part of application No. 10/937,249, filed on Sep. 10, 2004.

(51) Int. Cl.
*B24B 23/03* (2006.01)

(52) U.S. Cl. ..... 451/359; 451/295

(58) Field of Classification Search ..... 451/359, 451/295, 358, 353, 344, 360, 259
See application file for complete search history.

(56) References Cited

U.S. PATENT DOCUMENTS 1,270,808 A * 7/1918 Franklin ..... 173/59
2,211,216 A * 8/1940 Oster ..... 451/358
3,872,951 A * 3/1975 Hastings, Jr. ..... 188/69
3,899,852 A * 8/1975 Batson ..... 451/359
4,400,995 A * 8/1983 Palm ..... 74/527
5,766,062 A * 6/1998 Edling ..... 451/451

FOREIGN PATENT DOCUMENTS

EP 235598 * 9/1987

* cited by examiner

*Primary Examiner*—Robert A. Rose
(74) *Attorney, Agent, or Firm*—Troxell Law Office, PLLC

(57) ABSTRACT

A pneumatic grinder with easily replacing grinding disc, including: a main body in which a rotary shaft is eccentrically pivotally connected with and is driven by a drive shaft of the pneumatic grinder, a bottom end of the rotary shaft being for mounting a grinding disc; a rotary member fixedly connected with the bottom end of the rotary shaft and synchronously rotatable with the rotary shaft; and an engaging mechanism movably mounted in the main body. When the engaging mechanism is moved to an engaging position, the engaging mechanism clogs the rotary member to prevent the rotary shat from rotating for replacing the grinding disc. After the replacement is completed, make the engaging mechanism move to a releasing position and releases the rotary member, permitting the rotary shaft to rotate.

20 Claims, 22 Drawing Sheets

PNEUMATIC GRINDER WITH EASILY REPLACING GRINDING DISC

This application is a Continuation-in-Part of application Ser. No. 10/937,249, entitled GRINDER WITH EASILY INSTALLABLE/DETACHABLE GRINDING DISC, filed on Sep. 10, 2004.

BACKGROUND OF THE INVENTION

The present invention is related to a grinder, and more particularly to a pneumatic grinder in which the grinding disc can be easily changed.

A pneumatic grinder has a grinding disc mounted on the bottom of the grinder for grinding a work piece. The grinding disc is screwed with a rotary shaft of the grinder by a thread rod located on a top surface of the grinding disc. The rotary shaft is eccentrically pivotally connected with and is driven by a drive shaft of the pneumatic grinder. In operation, it is necessary to frequently replace the grinding disc.

Conventionally, when replacing the grinding disc, a flat wrench is extended into the bottom of the grinder for clogging the rotary shaft of the grinder. Under such circumstance, the grinding disc can be unscrewed from the rotary shaft and taken off. Similarly, when installing the grinding disc, it is also necessary to fix the rotary shaft. However, it is impossible for a user to directly see the state of the wrench fitted on the rotary shaft. Therefore, such replacement operation is quite inconvenient and time-consuming as well as dangerous.

European Patent No. 235,598 discloses an electric grinding tool that has lock for one section of a drive shaft secured against rotation by a lock member (a spring-loaded bolt).

Similarly, U.S. Pat. Nos. 4,400,995, 3,899,852, 3,872,951, 2,211,216, and 1,270,808 all disclose power rotary tools in which lock members lock drive shafts against rotation.

U.S. Pat. No. 5,766,062 discloses a power tool in which a lock member (an arresting device) locks a balancing device that is connected and coaxial with a drive shaft (spindle) for stopping the drive shaft from rotating.

All of the lock members of the above-mentioned patents directly stop the drive shafts of the tools from rotating. It is easy to chuck the drive shaft for its axial is stationary. For a pneumatic grinder, it is easy to chuck the drive shaft too, while it is uneasy to chuck the rotary shaft for its axial is not stationary. And for a pneumatic grinder, stopping the drive shaft is useless for changing a grinding disc, since the rotary shaft still rotates.

It is therefore tried by the inventor to develop a pneumatic grinder for solving the above problem existing in the conventional grinder.

SUMMARY OF THE INVENTION

It is therefore an object of the present invention to provide a pneumatic grinder to prevent the rotary shaft of the grinder from rotating when replacing a grinding disc.

It is another object of the present invention to provide a pneumatic grinder in which an engaging mechanism is for stopping the rotary shaft of the grinder from rotating, the engaging mechanism can be driven by different kind of power sources.

The present invention can be best understood through the following description and accompanying drawings wherein:

DETAILED DESCRIPTION OF THE PREFERRED EMBODIMENTS

Figure 1:
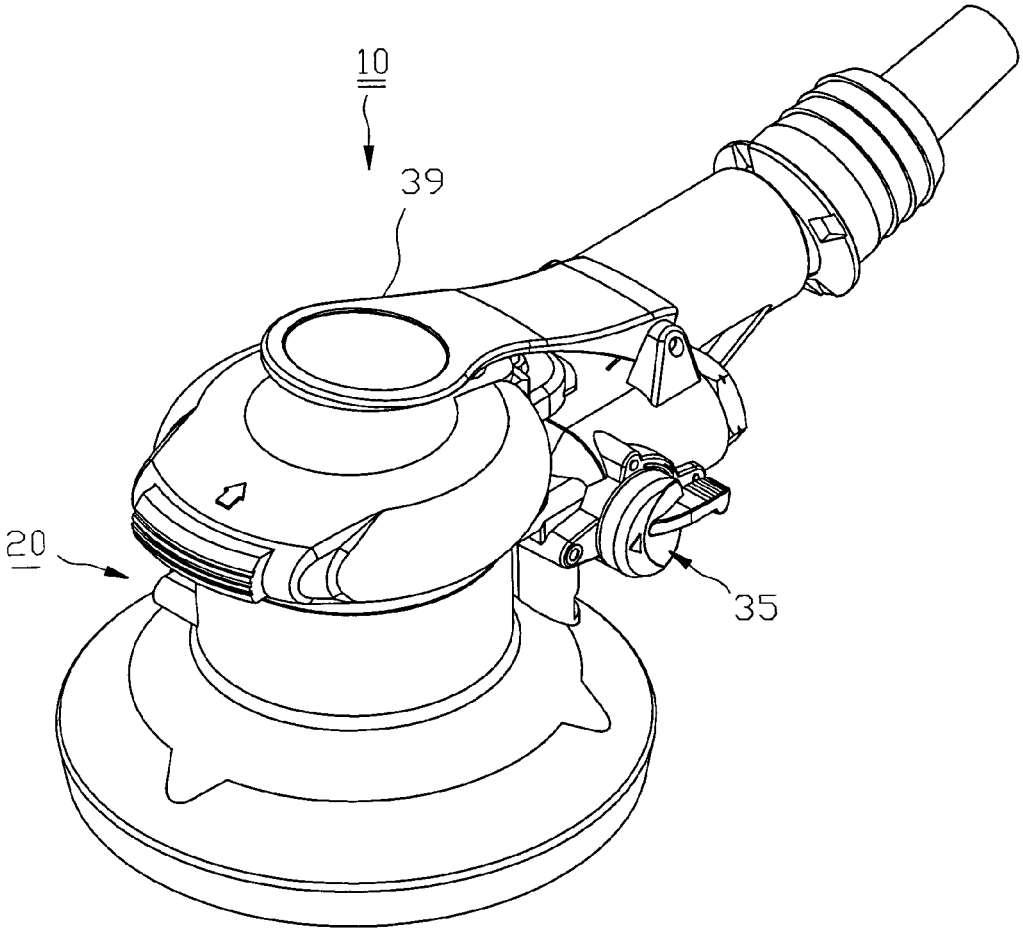
FIG. 1 is a perspective view of a preferred embodiment of the present invention.
Figure 2:
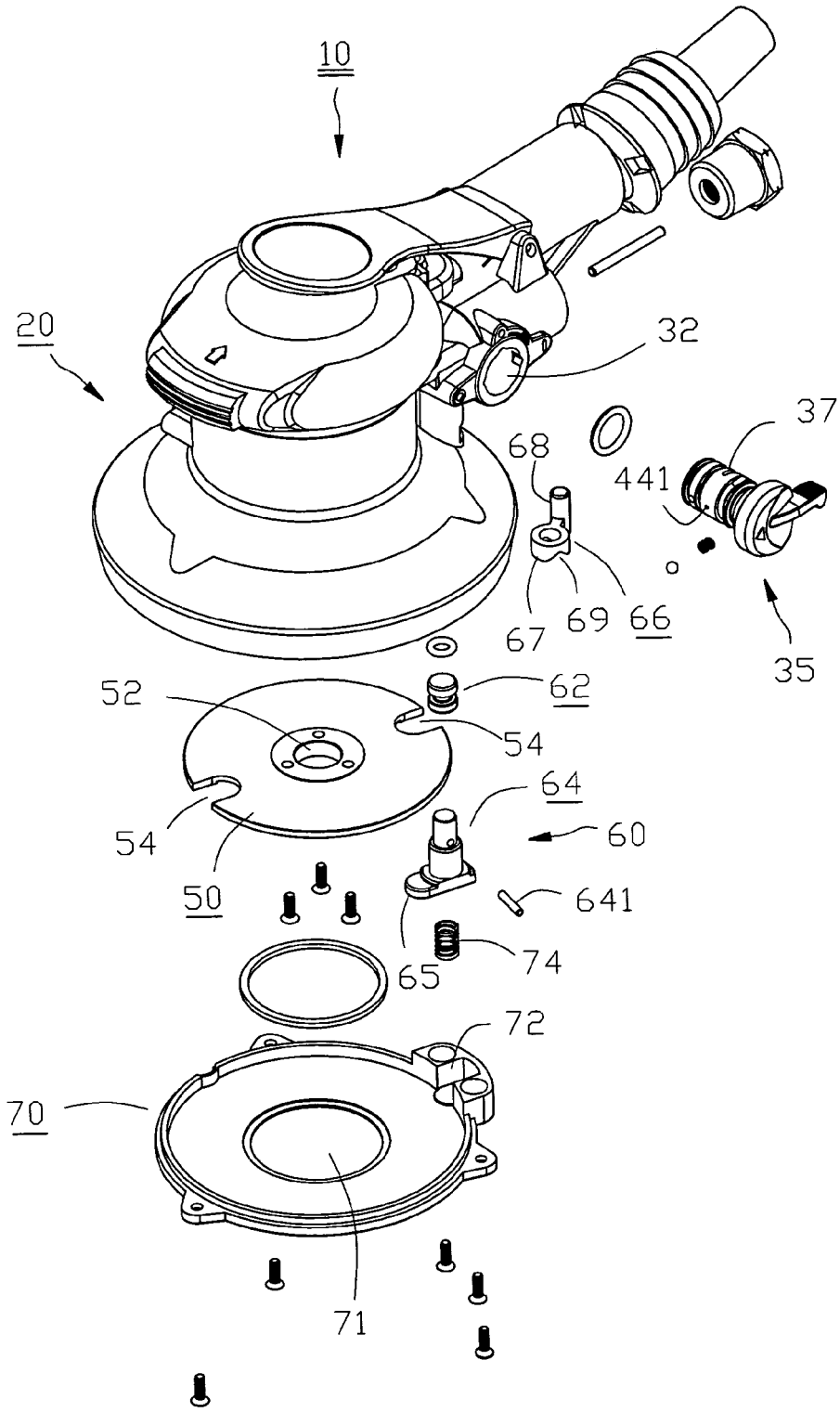
FIG. 2 is a perspective exploded view of the present invention according to FIG. 1.

Please refer to FIGS. 1 and 2. According a first embodiment of the present invention, the pneumatic grinder is equipped with a rotary member and an engaging mechanism.

Figure 3:
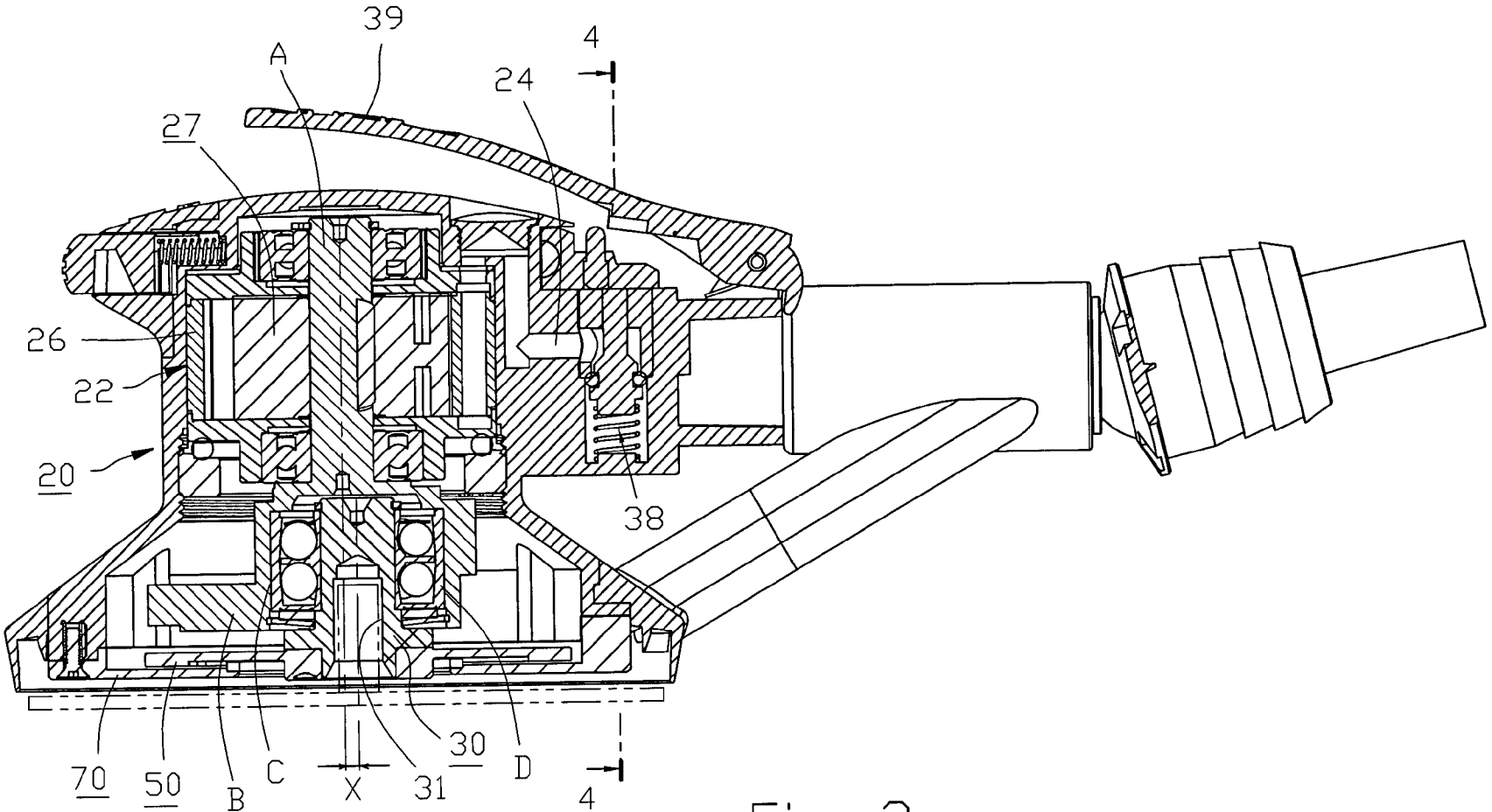
FIG. 3 is a longitudinal sectional view of the present invention according to FIG. 1.

The grinder 10 includes a main body 20. Referring to FIG. 3, the inside of the main body 20 is formed with a cylinder chamber 22 and a flow way 24. High-pressure air flows through the flow way 24 into the cylinder chamber 22 for driving a rotor 27 of a pneumatic cylinder 26 to rotate. The rotor 27 has a drive shaft A. A weight block B is integrally formed with the bottom end of the drive shaft A. A bottom face of the weight block B is formed with a cavity C. A rotary shaft 30 is disposed on the bottom of the grinder and is pivotally disposed in the cavity C. A bearing D is arranged between the rotary shaft 30 and the weight block B. The power supply of the grinder drives the drive shaft A to rotate for driving the rotary shaft 30 to rotate. That is, the rotary shaft 30 is a driven shaft drivable by the drive shaft A. The bottom end of the rotary shaft 30 is formed with a thread hole 31, whereby a grinding disc (as shown by the phantom line) can be screwed with the rotary shaft.

Figure 26:
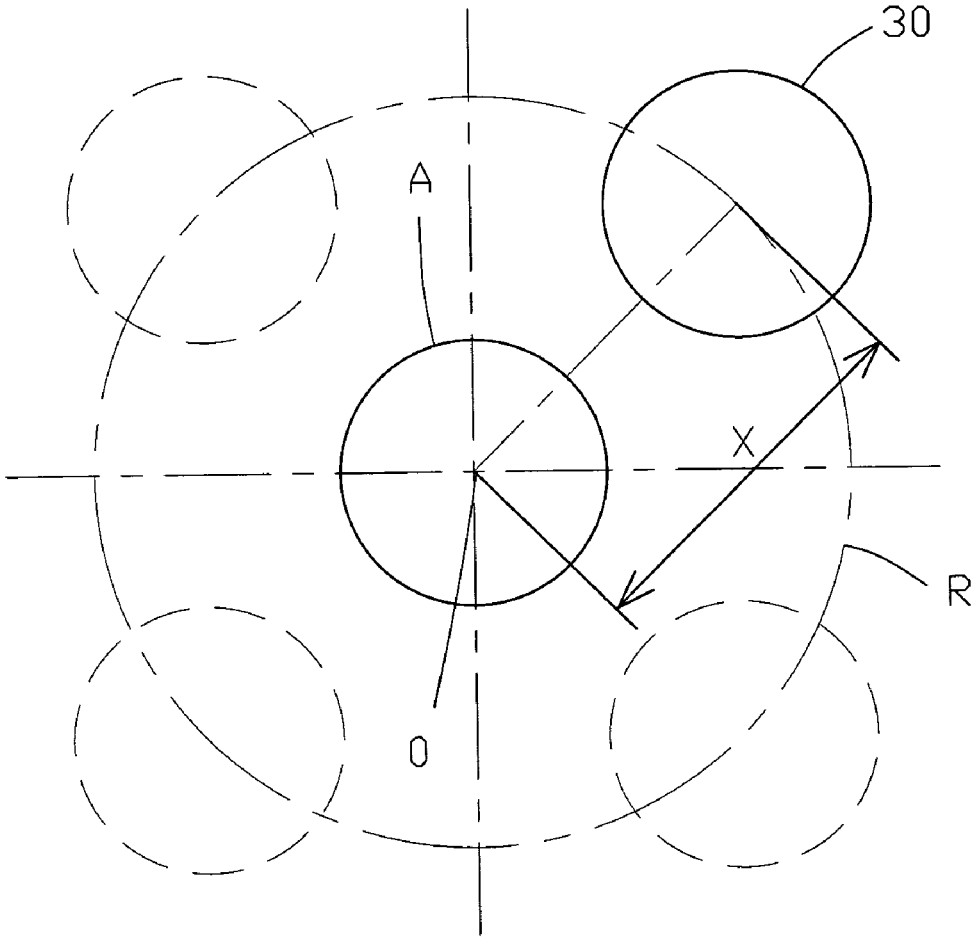
FIG. 26 is a diagram showing the relationship of the drive shaft and the rotary shaft.

The rotary shaft 30 is eccentrically pivotally connected with the drive shaft A of the rotor 27. The axis of the rotary shaft 30 is displaced from the axis of the drive shaft A by a displacement X. Referring to FIG. 26, the drive shaft A rotates about the origin point O, while the rotary shaft 30 not only rotates in the weight block B, but also revolves in a circular track R. The radius of the track R is just the displacement X. When the drive shaft A stops rotating, the rotary shaft 30 may be positioned in any position of the track R as shown by phantom line or solid line. The axial of the drive shaft is stationary, while the axial of the rotary shaft is not stationary.

Figure 4:
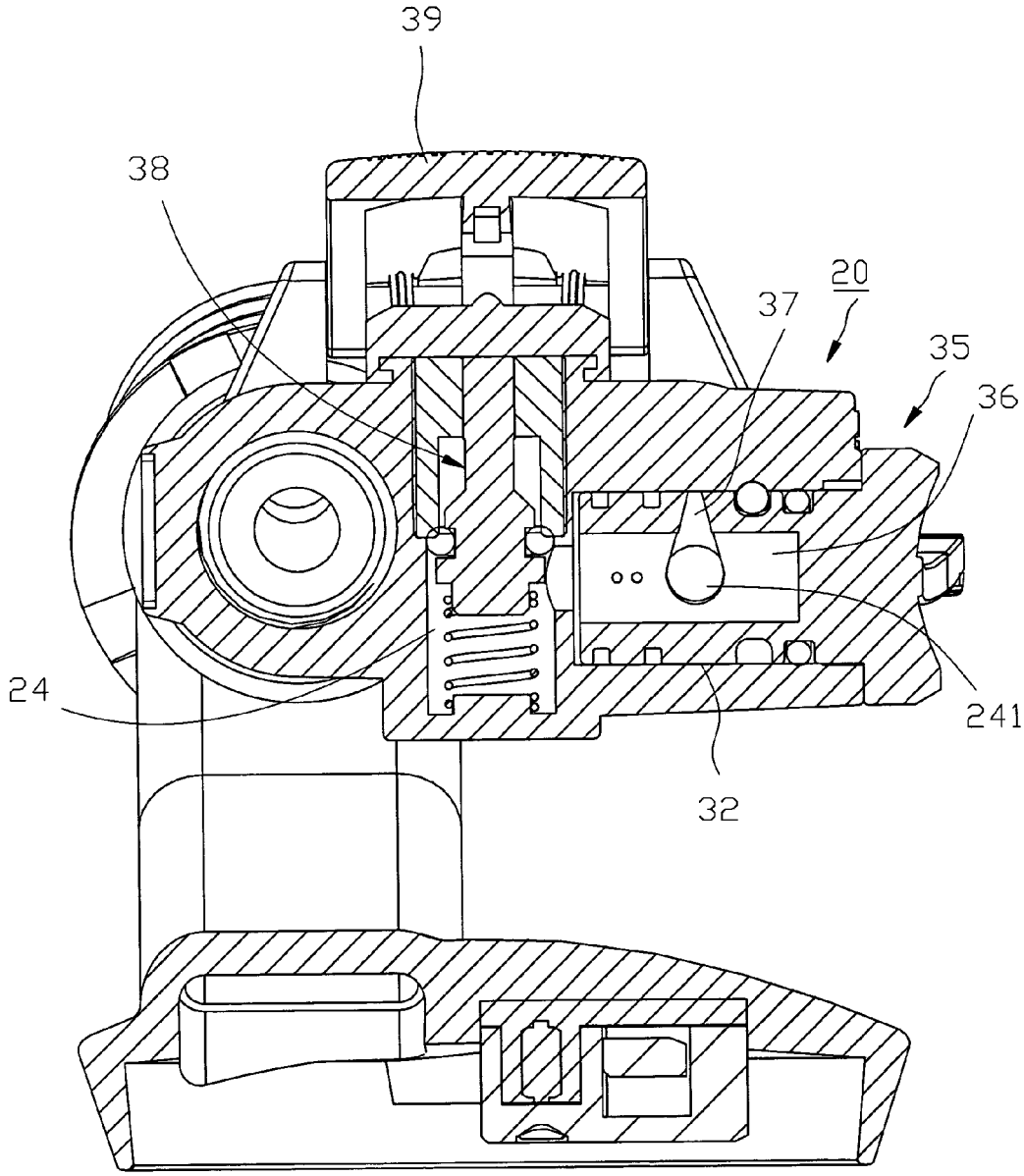
FIG. 4 is a sectional view taken along line 4—4 of FIG. 3.
Figure 5:
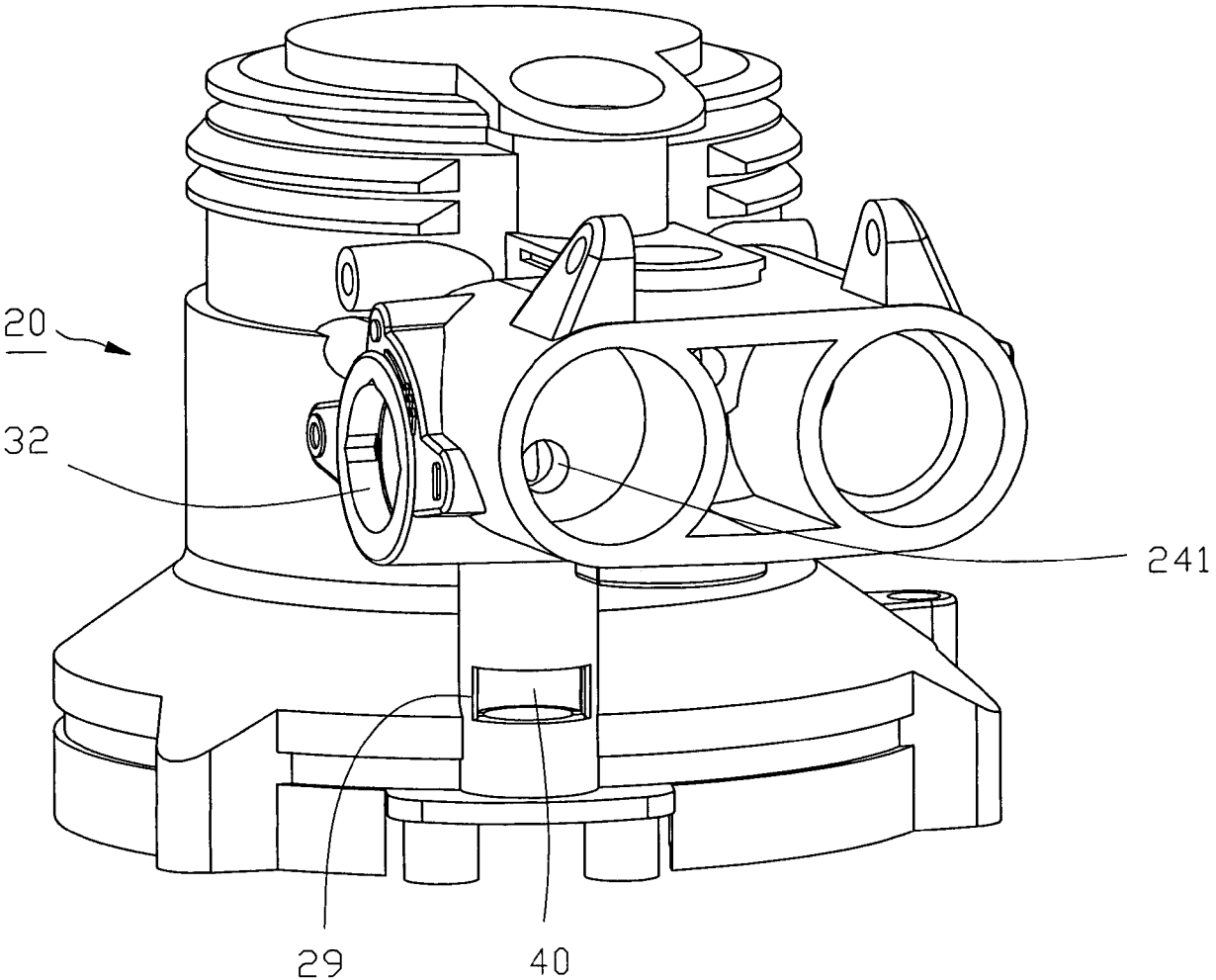
FIG. 5 is a rear perspective view of the main body of the present invention.

Referring to FIGS. 3 to 5, one side of the main body 20 is formed with a valve room 32 communicating with the inlet 241 of the flow way 24. An intake button 35 is airtight pivotally disposed in the valve room 32. An inner end of the intake button is formed with a shaft hole 36. The circumference of the intake button is formed with an intake 37 communicating with the shaft hole 37. Accordingly, the high-pressure air can flow from the inlet 241 through the intake 37 and shaft hole 36 into the flow way 24 for activating the pneumatic cylinder 26. A switch 38 is disposed in the main body 20. In normal state, the switch 38 blocks the flow way 24. A user via a trigger 39 can shift the switch 38 to unblock the flow way. By means of turning the intake button 35, the flow amount of the air can be controlled. The above operation and structure have been disclosed in relevant applications of this applicant and thus will not be further described hereinafter.

Figure 6:
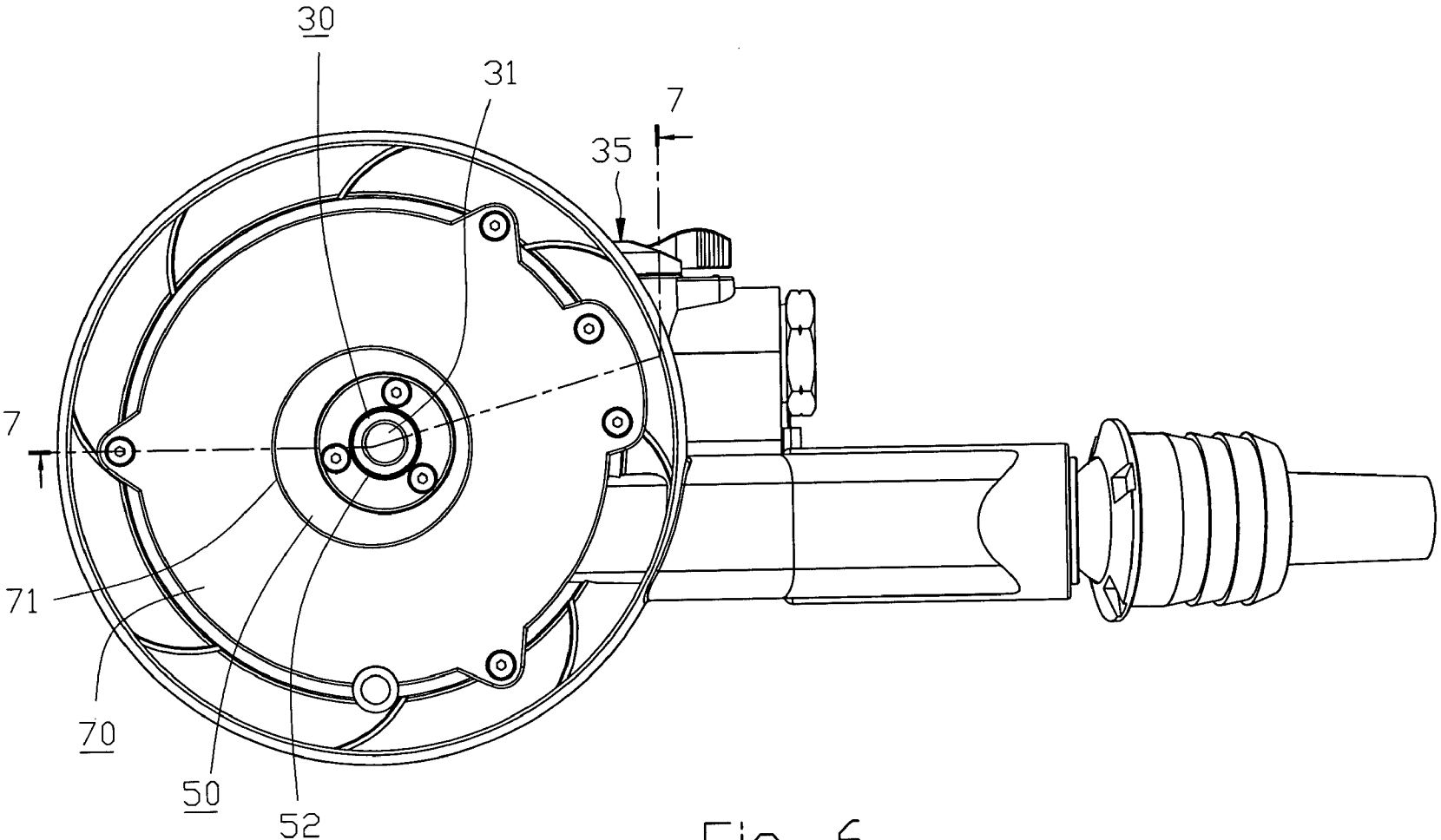
FIG. 6 is a bottom view according to FIG. 1.
Figure 7:
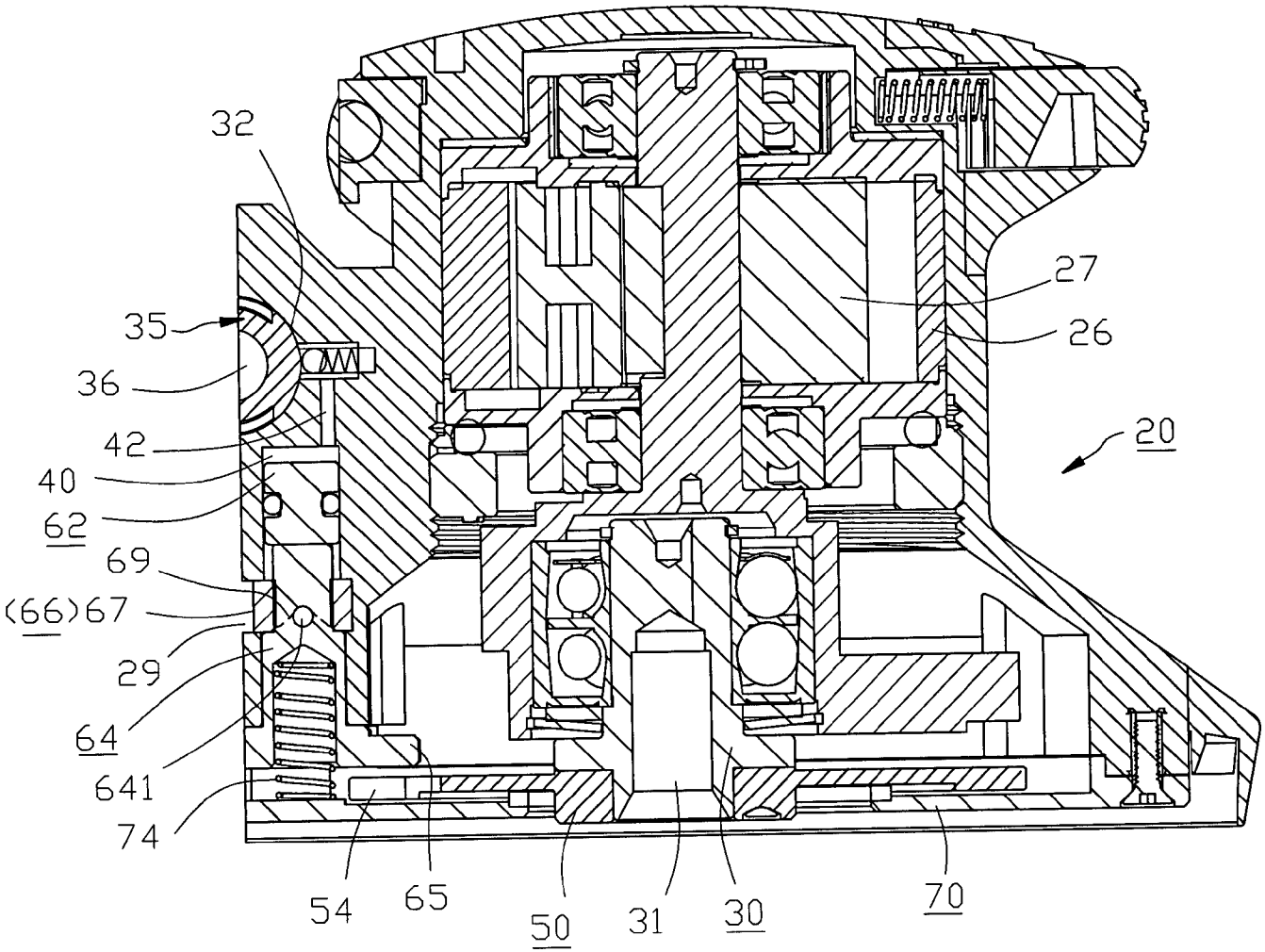
FIG. 7 is a sectional view taken along line 7—7 of FIG. 6.
Figure 8:
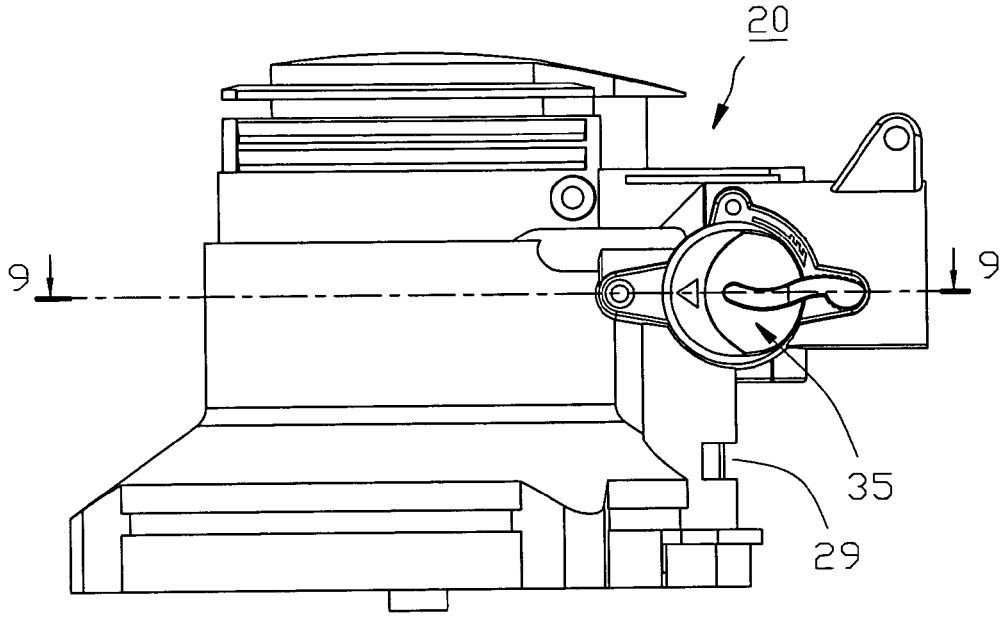
FIG. 8 is a side view showing the main body and intake button of the present invention.
Figure 9:
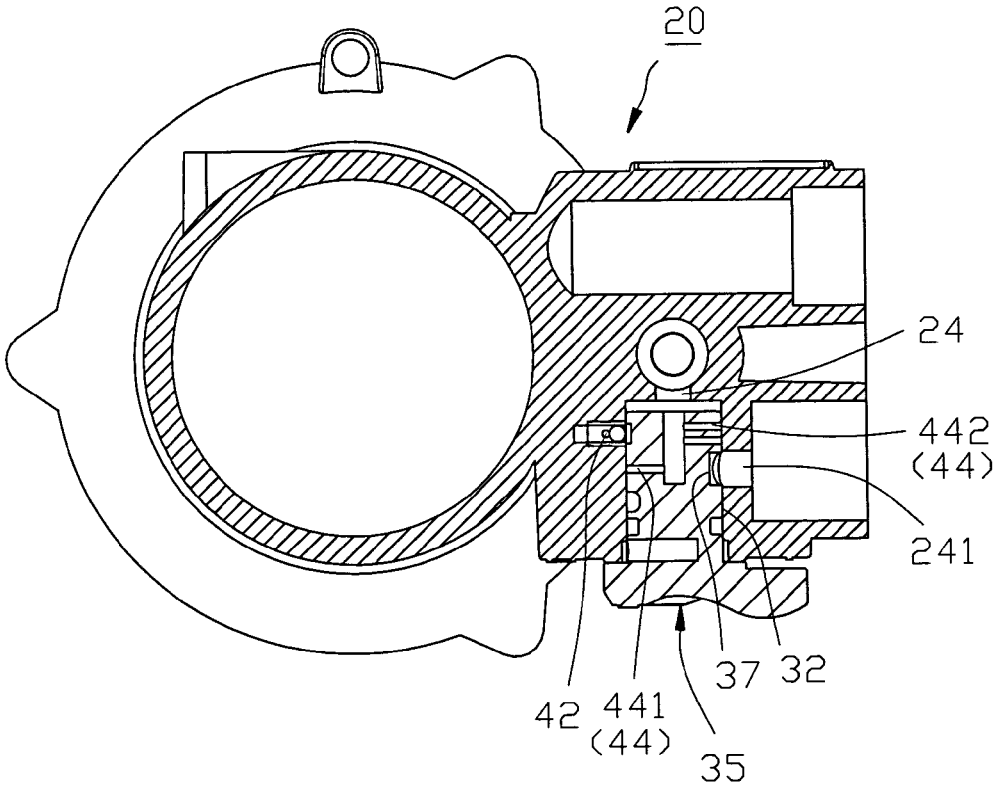
FIG. 9 is a sectional view taken along line 9—9 of FIG. 8.

In this embodiment, referring to FIGS. 5 to 7, the main body is formed with a vertical slide way 40. The bottom end of the slide way extends to the bottom of the main body. The top end of the slide way via a small flow way 42 communicates with the valve room 32. Accordingly, the small flow way 42 substantially communicates with the flow way 24. In addition, referring to FIGS. 8 and 9, the circumference of the intake button 35 is formed with a conducting hole 44 including a first perforation 441 and a second perforation 442 respectively formed on front and rear sides of the intake button at 180 degree interval. When the intake button is positioned in the blocking position as shown in FIGS. 8 and 9, the conducting hole 44 does not communicate with the small flow way 42 so that the high-pressure air will not flow into the slide way 40.

Referring to FIG. 2, in this embodiment, the rotary member 50 is a circular disc. However, this is not limited. For example, the rotary member can be alternatively an elongated plate body. The rotary member 50 is fixedly connected with the bottom end of the rotary shaft 30 as shown in FIG. 3 and synchronously rotatable with the rotary shaft. A predetermined number of engaging sections 54 are formed on the circumference of the rotary member. The engaging sections 54 are long engaging holes with their longitudinal along the radial of the rotary member 50.

In this embodiment, the engaging mechanism 60 includes a piston 62, an engaging column 64 and a shift button 66 for controlling the engaging column 64. The piston 62 and the engaging column 64 are vertically movably mounted in the slide way 40. The piston 62 is airtight fitted in the slide way to prevent the high-pressure air from escaping. The engaging column 64 is positioned under the piston. The bottom end of the engaging column 64 is formed with an engaging portion 65. The shift button 66 is passed through a window 29 of the main body 20 (as shown in FIG. 5) and fitted on the body of the engaging column 64. By means of shifting the shift button 66, the engaging column can be controlled to move up and down. In order to achieve this object, the shift button and the engaging column cooperate with each other as a cam. A pin 641 is fitted through the body of the engaging column. The shift button has a cylindrical button body 67 and a shift section 68. The bottom face of the button body 67 has a cam section 69. The button body 67 of the shift button is fitted on the engaging column with the cam section 69 contacting with the pin 641 of the engaging column. The shift sect ion 68 extends to the window 29 and is exposed. The shift button 66 is kept at a fixed height of the window 29 so that by means of turning the shift button, the height of the engaging column can be controlled.

Figure 10:
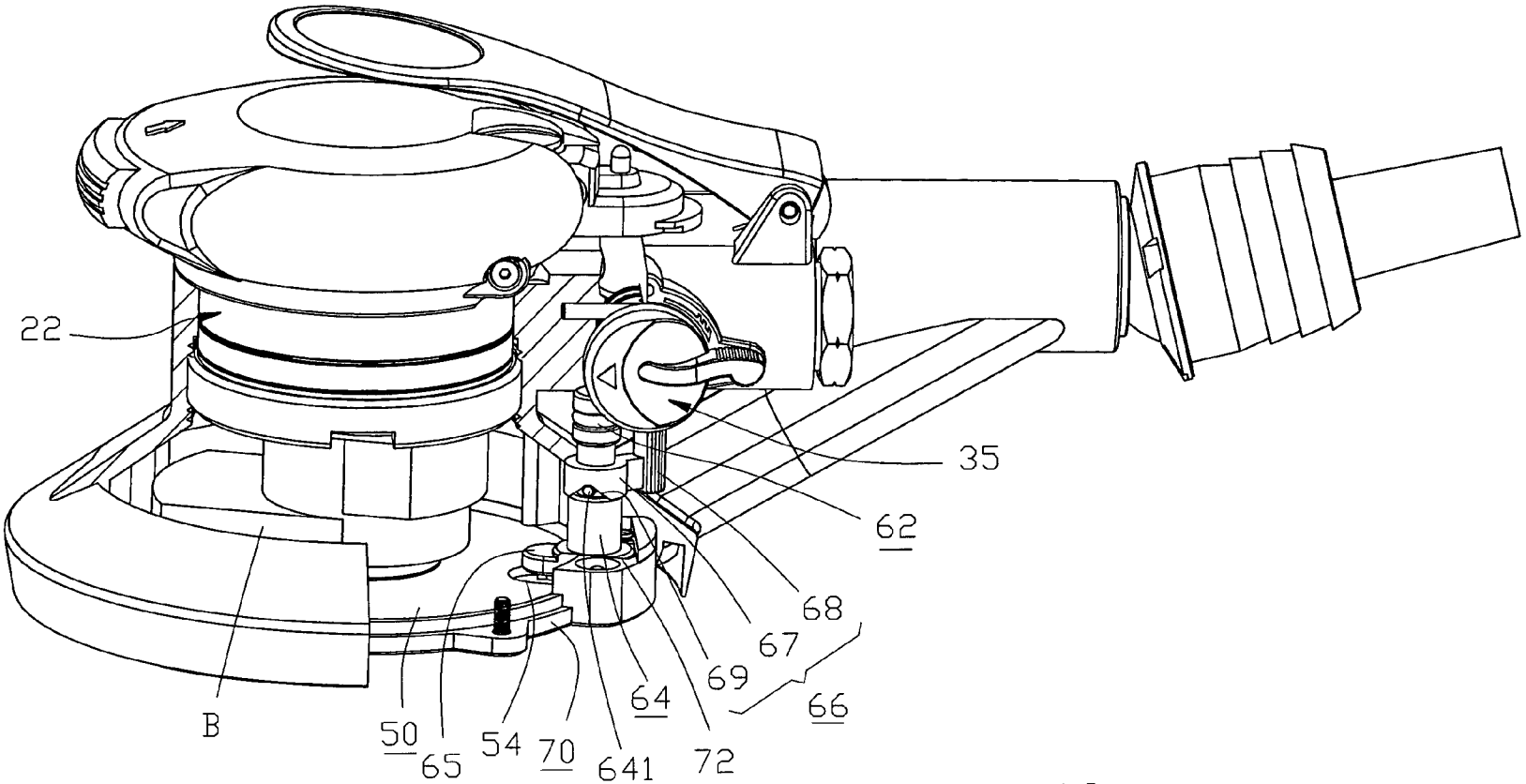
FIG. 10 is a perspective partially sectional view according to FIG. 1.

The engaging mechanism 60 further includes a base seat 70 fixed connected with the bottom end of the main body 20 by screws. The rotary member 50 is positioned above the base seat 70. The rotary member and the base seat are both formed with through holes 52, 71 to avoid the thread hole of the rotary shaft. The top face of the base seat 70 is formed with a recess 72 for snugly accommodating the engaging portion 65 of the bottom end of the engaging column 64. The recess 72 has a shape corresponding to that of the engaging port ion 65 as shown in FIG. 10, whereby the engaging column can only move up or down without rotating. A spring 74 is disposed in the recess of the base seat for lifting the engaging column 64 as shown in FIG. 7, whereby the engaging column and the piston tend to move upward in normal state.

Referring to FIG. 9, in general use, the conducting hole 44 of the intake button 35 does not communicate with the small flow way 42. Therefore, the engaging mechanism 60 is not activated by the high-pressure air and is pushed and lifted by the spring 74. The bottom end of the engaging column 64 is higher than the rotary member 50 and is not engaged with the rotary member. The intake 37 of the intake button 35 permits the high-pressure air to flow into the flow way 24 as shown in FIG. 4. When pulling the trigger 39, the flow way is unblocked, whereby the high-pressure air can drive the rotor 27 to further drive the rotary shaft 30, rotary member 50 and grinding disc to rotate for grinding a work piece.

When replacing the grinding disc, the present invention provides two measures for driving the engaging mechanism.

Figure 11:
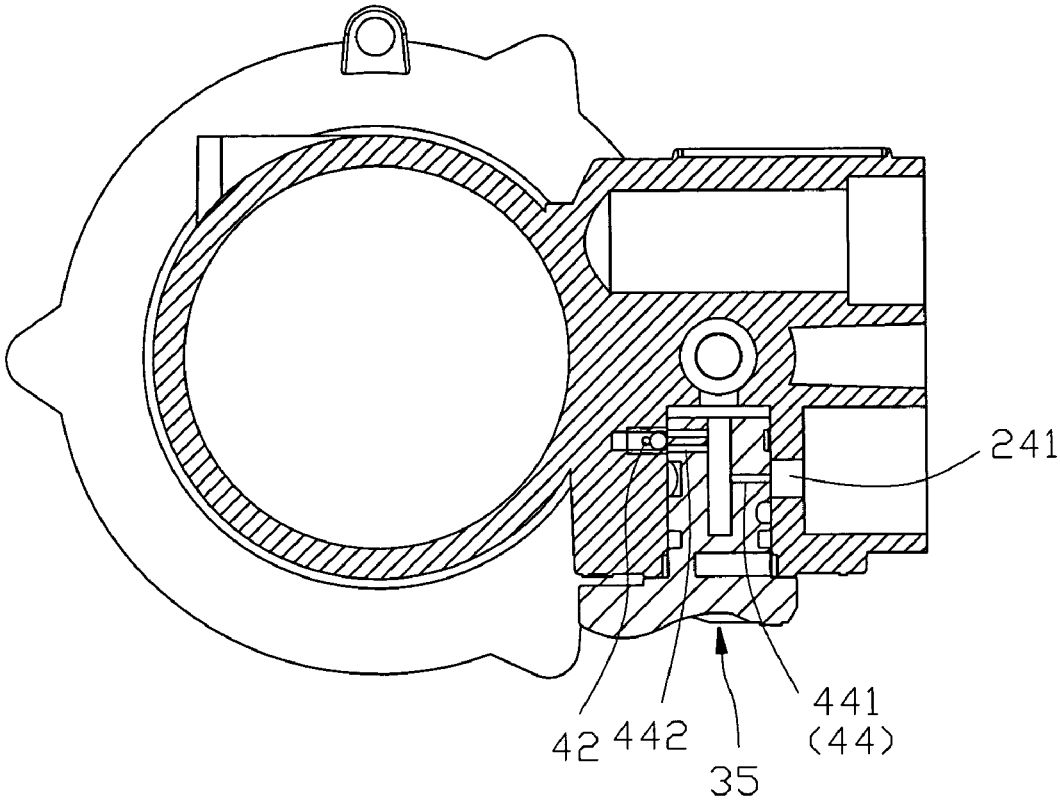
FIG. 11 is a view according to FIG. 9, showing that the small flow way is unblocked.
Figure 12:
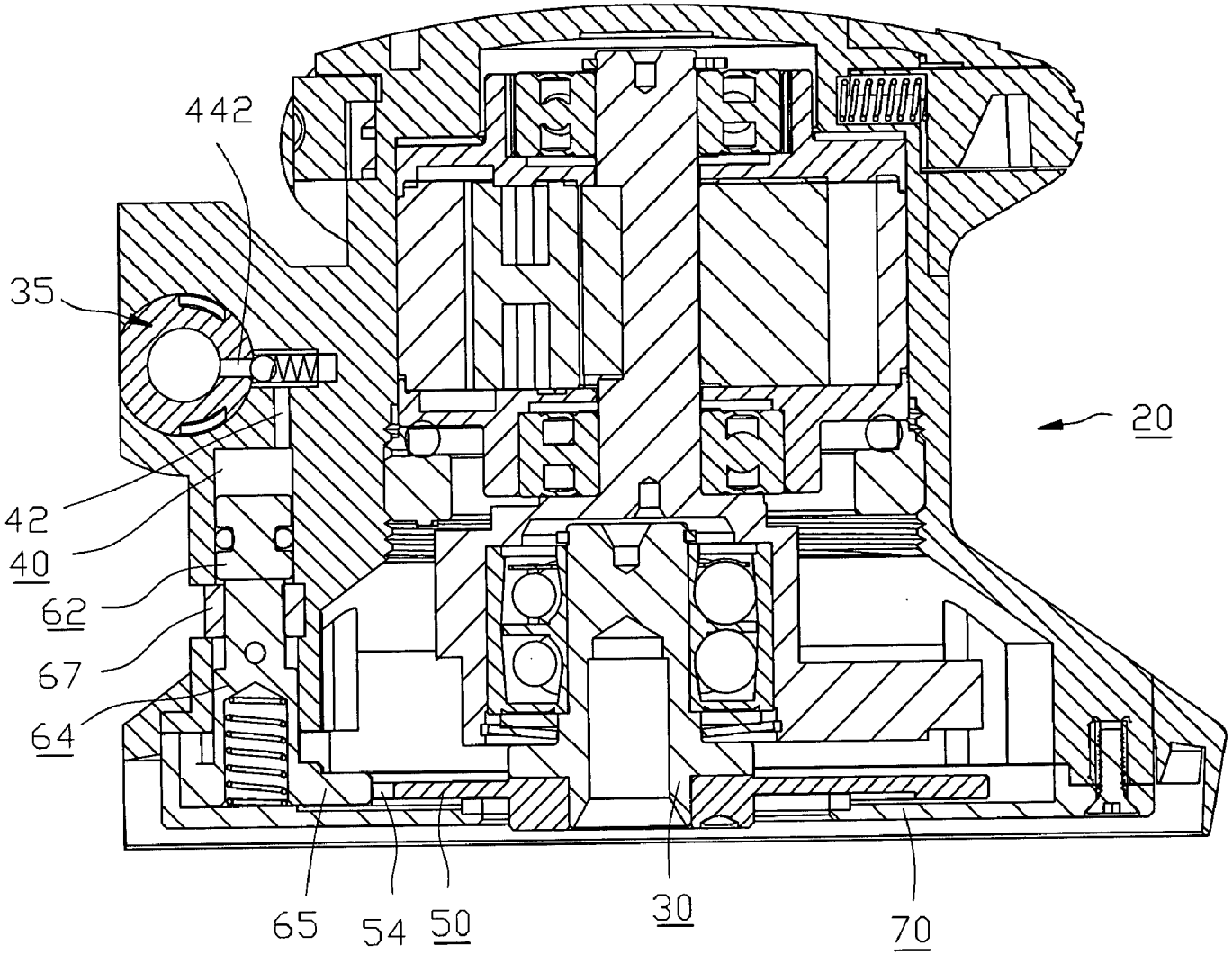
FIG. 12 is a view according to FIG. 7, showing the operation of the present invention.

In the first measure, the high-pressure air serves as the power source. The intake button 35 is 180 degrees turned to an unblocking position as shown in FIG. 11. At this time, the first perforation 441 of the conducting hole 44 communicates with the inlet 241 of the flow way, while the second perforation 442 communicates with the small flow way 42. Accordingly, the high-pressure air goes into the slide way 40 to push the piston 62 and engaging column 64 downward as shown in FIG. 12. The engaging portion 65 of the bottom end of the engaging column is fitted into the engaging hole 54 of the rotary member 50 to clog the rotary member. Under such circumstance, the rotary shaft 30 is fixed without possibility of rotation. At this time, a user can detach/install the grinding disc.

After the installation of the grinding disc is completed, the intake button 35 is turned back to the position as shown in FIG. 9 to interrupt the communication between the conducting hole 44 and the small flow way 42. At this time, the high-pressure air no more exists in the slide way 40 and the engaging mechanism is lifted by the spring 74, whereby the bottom end of the engaging column 64 is not more engaged with the rotary member 50. The rotary shaft 30 and the rotary member can be freely rotated.

The second measure is manual operation. Referring to FIG. 10, in common state, the shift button 66 is positioned in a releasing position. At this time, the pin 641 of the engaging column 64 contacts with the trough of the cam section 69 of the shift button so that the engaging column 64 is positioned at the upper dead end.

Figure 13:
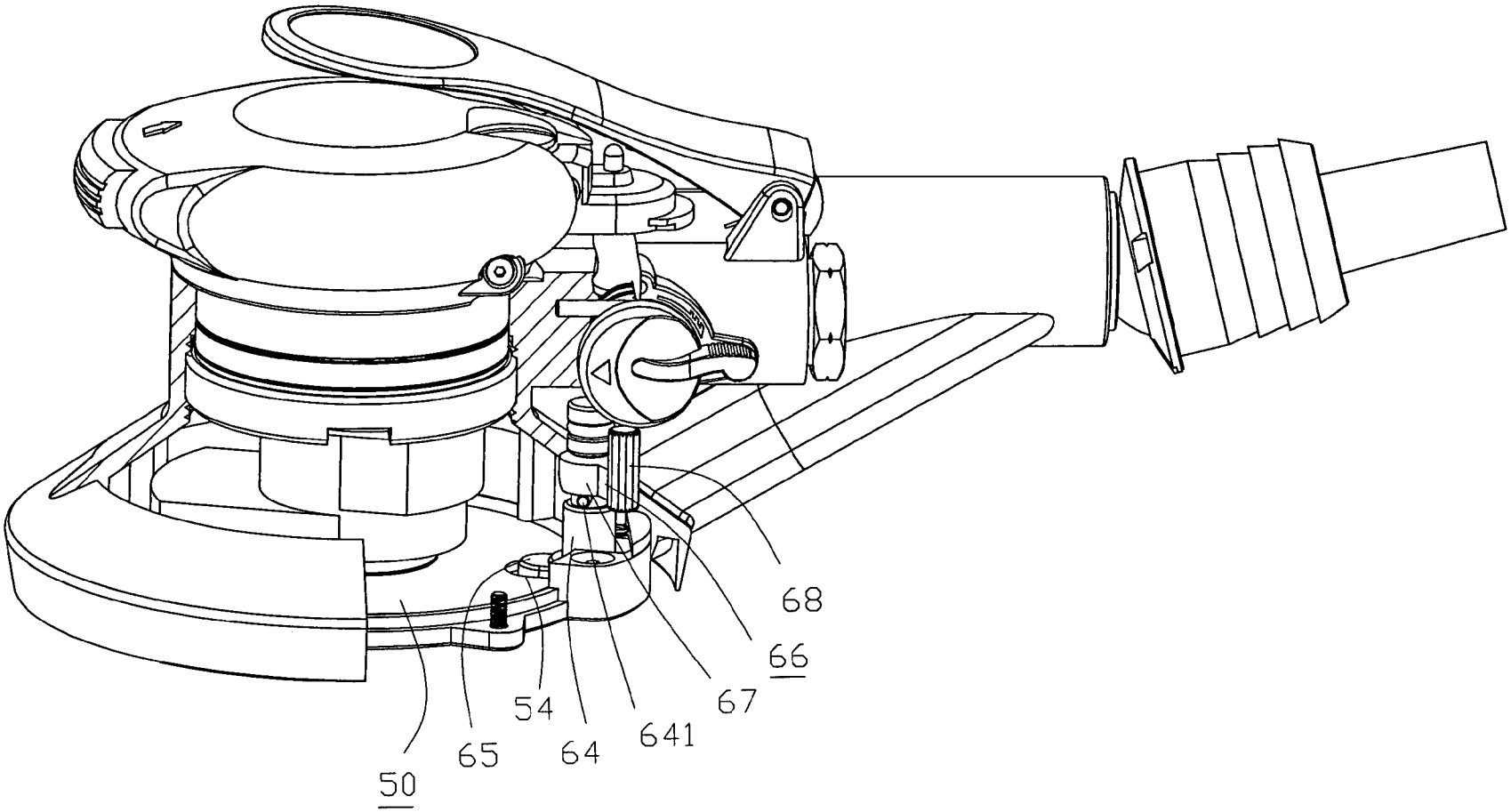
FIG. 13 is a view according to FIG. 10, showing the operation of the shift button.

When the user turns the shift button 66 to the engaging position as shown in FIG. 13, the shift button is angularly displaced and the plane face of the bottom end of the cam section 69 contacts with the pin 641 to drive the engaging column 64 to move downward. The bottom end of the engaging column 64 is also engaged in the engaging hole 54 of the rotary member to clog the rotary shaft.

After the replacement of the grinding disc is completed, the shift button 66 is turned back to the position as shown in FIG. 10. At this time, the engaging column 64 is lifted by the spring 74 to release the rotary member.

Figure 14:
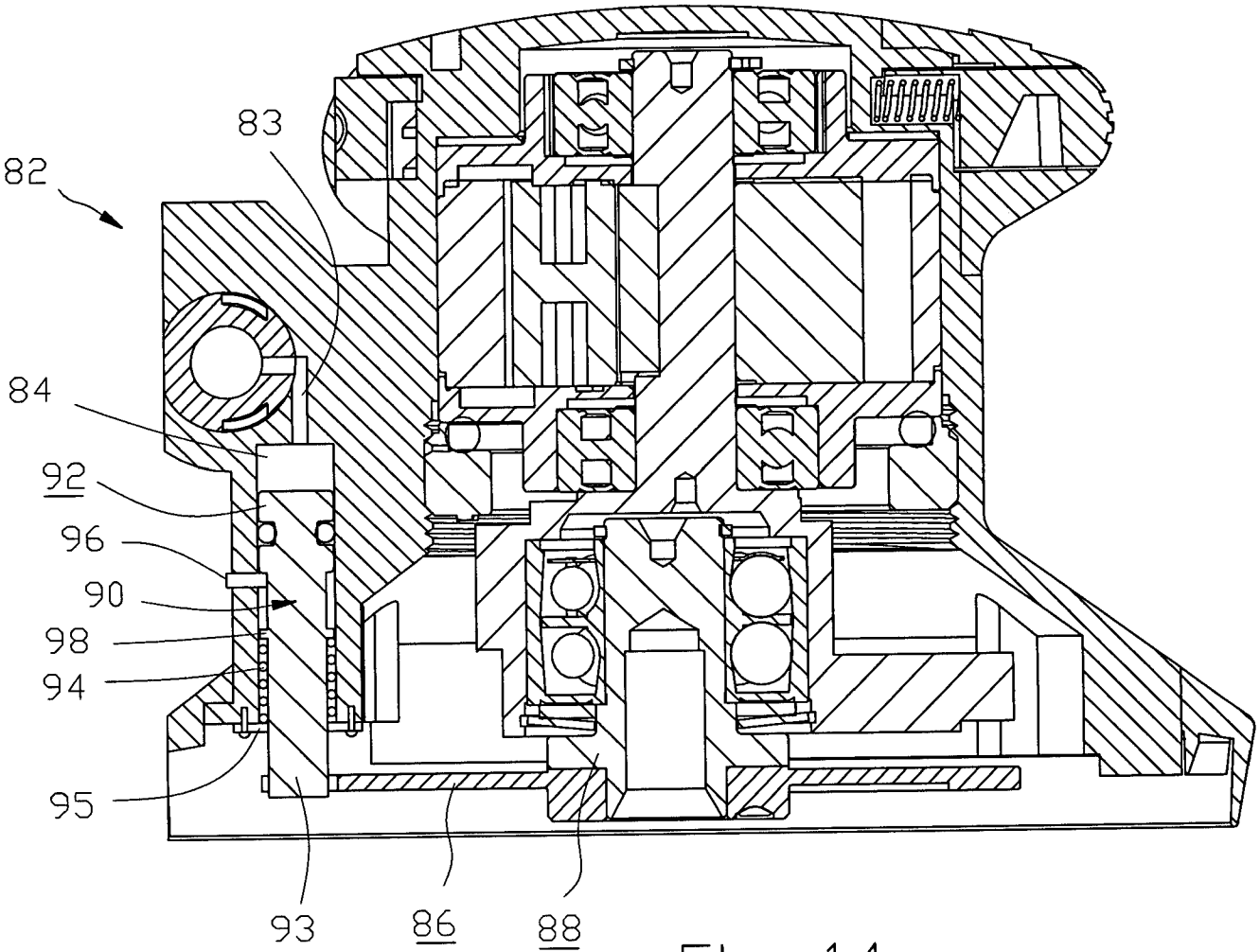
FIG. 14 is a sectional view of another embodiment of the present invention.

FIG. 14 is a sectional view showing another embodiment of the present invention, in which all the structures are identical to the above embodiment except the engaging mechanism. The engaging mechanism 90 includes a piston 92 and a spring 94 (without the engaging column and the base seat). The piston and the spring are mounted in the slide way 84 of the main body 82. The bottom end of the piston 92 is connected with a column body 93. The bottom end of the column body extends through a washer 95. When the high-pressure air flows from the small flow way 83 into the slide way 84 to drive the piston to move downward, the bottom end of the piston is engaged with the rotary member 86 to locate the rotary shaft 88. A locating pin 96 serves as a lower dead end of the piston. Two ends of the spring 94 respectively abut against the washer 95 and a shoulder section 98 of the piston. When the piston is free from the air pressure, the spring can lift the piston to release the rotary member.

Figure 15:
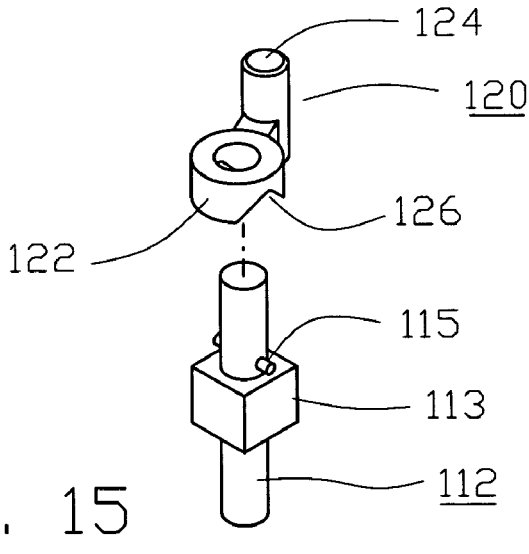
FIG. 15 is a sectional view of still another embodiment of the present invention.
Figure 16:
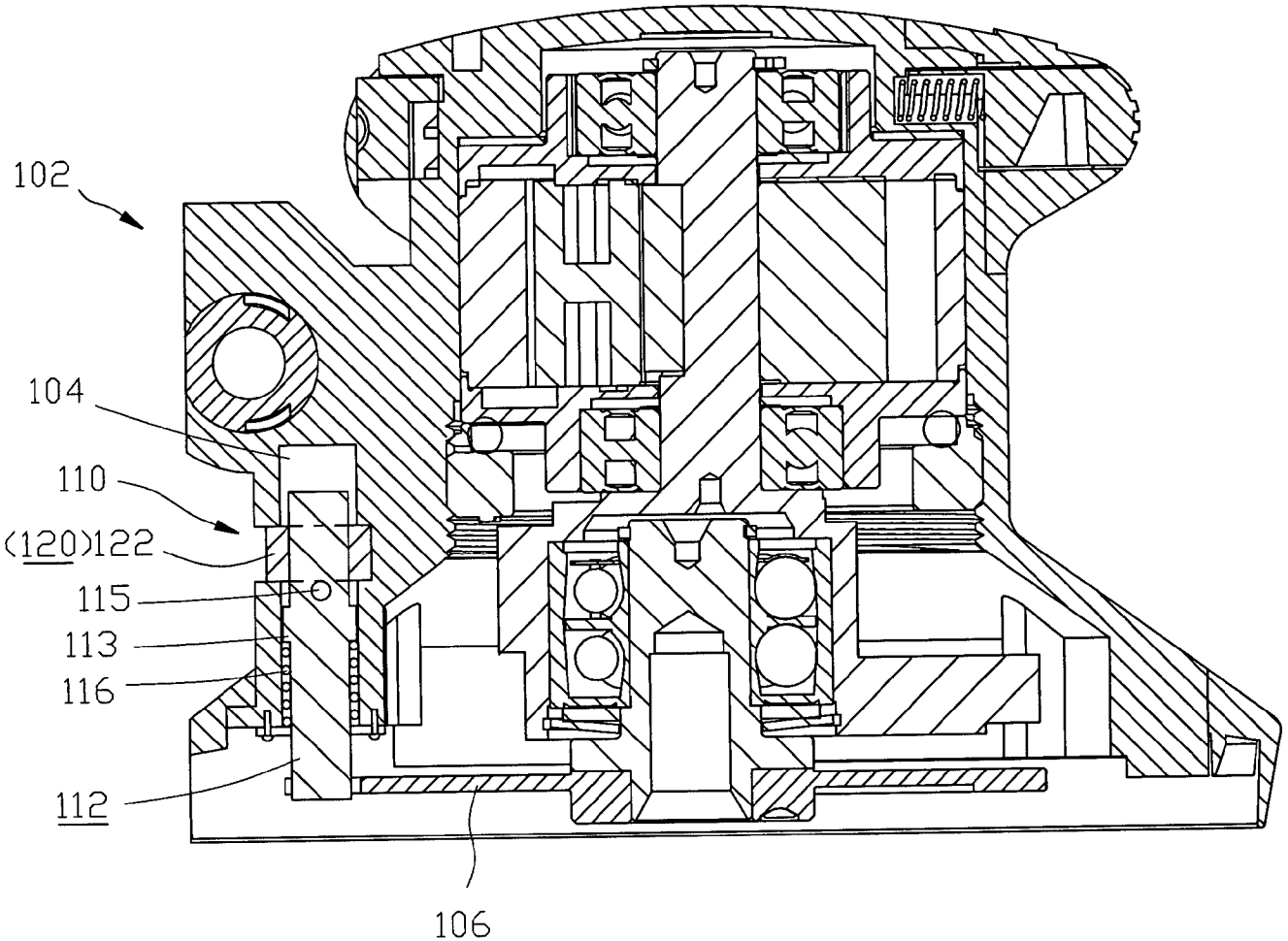
FIG. 16 is a perspective view of the engaging mechanism of FIG. 15.

FIGS. 15 and 16 show still another embodiment of the present invention, in which the engaging mechanism 110 includes an engaging column and a shift button. The engaging column 112 is vertically movably fitted in the slide way 104 of the main body 102 and supported by a spring 116. In normal state, the engaging column 112 is kept at an upper dead end. The slide way has a polygonal cross-section. The body of the engaging column has a polygonal section 113 adapted to the cross-section of the slide way, whereby the engaging column can only vertically move within the slide way without rotation. The shift button 120 is identical to that of the first embodiment, having a button body 122 and a shift section 124. The button body 122 extends through the window of the main body into the slide way and is fitted on the engaging column. The cam section 126 of the button body cooperates with the pin 115 of the engaging column, whereby when turning the shift button, the engaging column can be controlled to move up or down. This operation is identical to that of the first embodiment. When the engaging column is moved downward to the engaging position, the bottom end of the engaging column clogs the rotary member 106.

Figure 17:
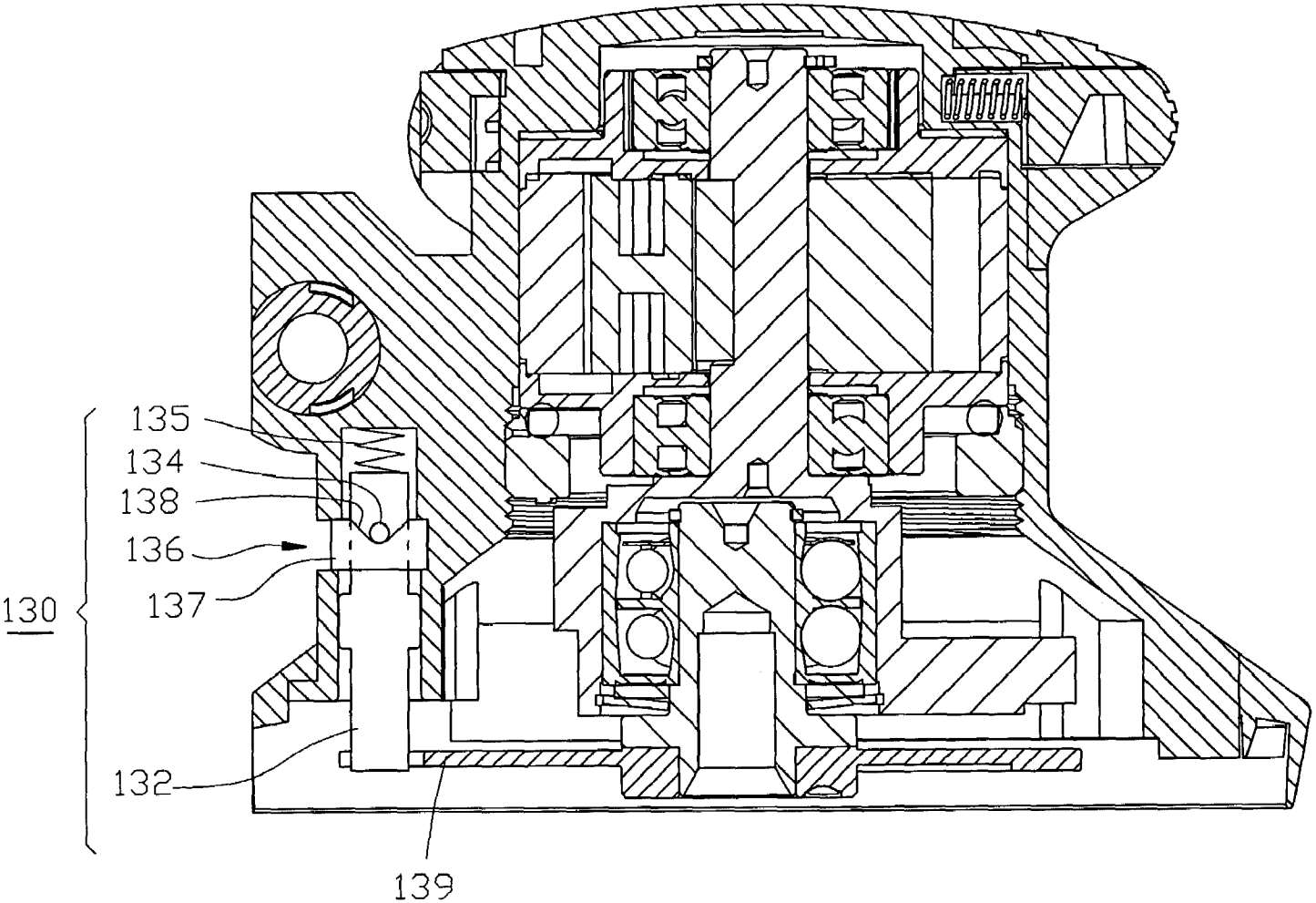
FIG. 17 is a sectional view of still another embodiment of the present invention.

FIG. 17 shows still another embodiment of the present invention, in which only the engaging mechanism 130 is shown. The engaging mechanism is substantially identical to that of FIG. 16. The difference between the two engaging mechanisms is that the spring 135 abuts against the top end of the engaging column 132 so that the engaging column tends to move downward in normal state. The cam section 138 is formed on top face of the button body 137 of the shift button 136 for contacting with the pin 134 of the engaging column. Accordingly, when turning the shift button to move the pin 134 into the trough of the cam section 138, the engaging column 132 is moved downward to clog the rotary member 139. Reversely, when the pin 134 contacts with the top face of the button body 137, the engaging column is moved upward to release the rotary member.

Figure 18:
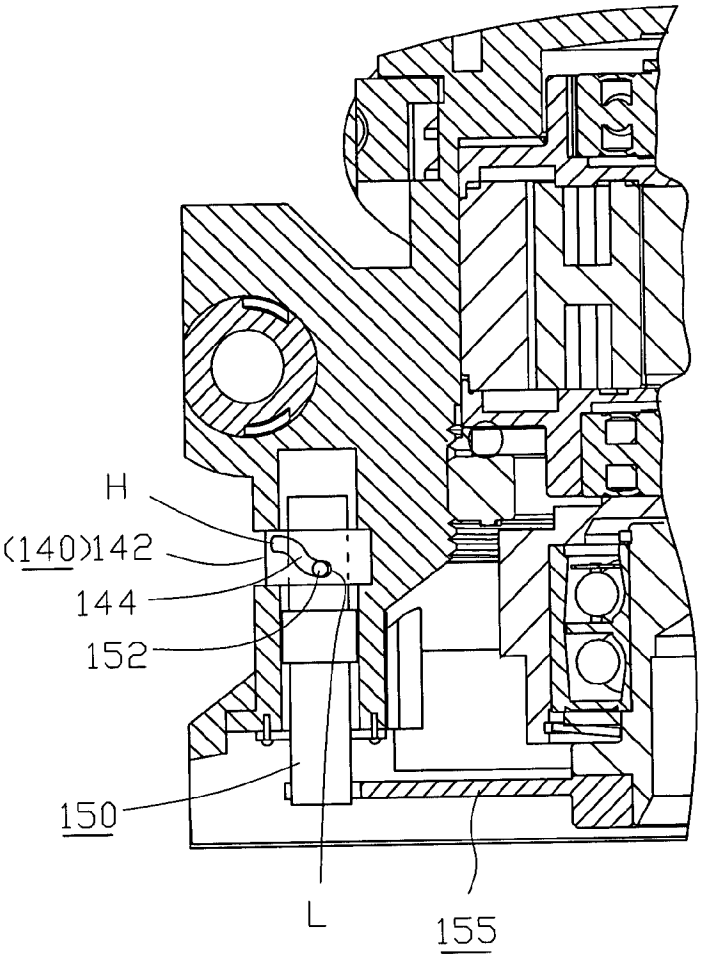
FIG. 18 is a sectional view of still another embodiment of the present invention.

FIG. 18 is a sectional view showing still another embodiment of the present invention, in which only the engaging mechanism is shown. In this embodiment, the shift button 140 also has a shift section (not shown) and a button body 142. The button body has a transverse guide slot 144 having a high level end H and a low level end L. The pin 152 of the engaging column 150 is fitted through the guide slot 144. The engaging column can only move up and down within the slide way without rotation. When turning the shift button to move the pin 152 of the engaging column to the low level end L, the engaging column is moved downward to clog the rotary member 155. Reversely, when the pin 152 of the engaging column is moved to the high level end H, the engaging column is moved upward to leave the rotary member. In this embodiment, a spring also can be disposed in the slide way to resiliently push the engaging column.

Figure 19:
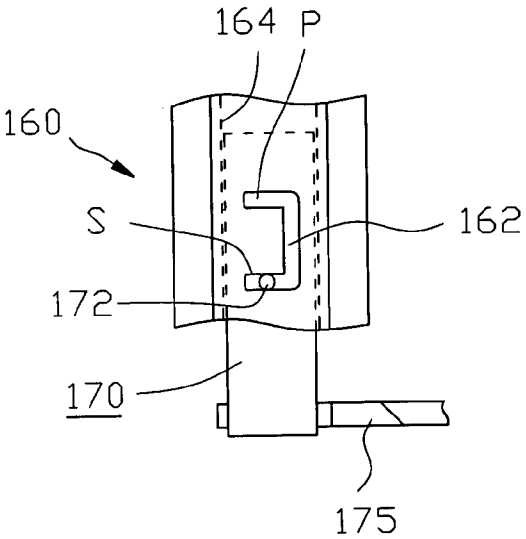
FIG. 19 shows the structure of still another embodiment of the present invention.

FIG. 19 shows the structure of still another embodiment of the present invention, in which the surface of the main body 160 of the grinder is formed with a longitudinal guide slot 162 communicating with the slide way 164. The guide slot 162 has a transverse high level section P at top end and a transverse low level section S at bottom end. The engaging column 170 is fitted in the slide way 164. A pin-like shift button 172 is inserted in the body of the engaging column and positioned in the guide slot 162. An outer end of the shift button is manually movable. When pushing the shift button 172, the engaging column is driven to move up and down. When the shift button 172 is moved into the low level section S, the bottom end of the engaging column clogs the rotary member 175. Reversely, when the shift button 172 is located in the high level section P, the engaging column is moved upward to leave the rotary member.

Figure 20:
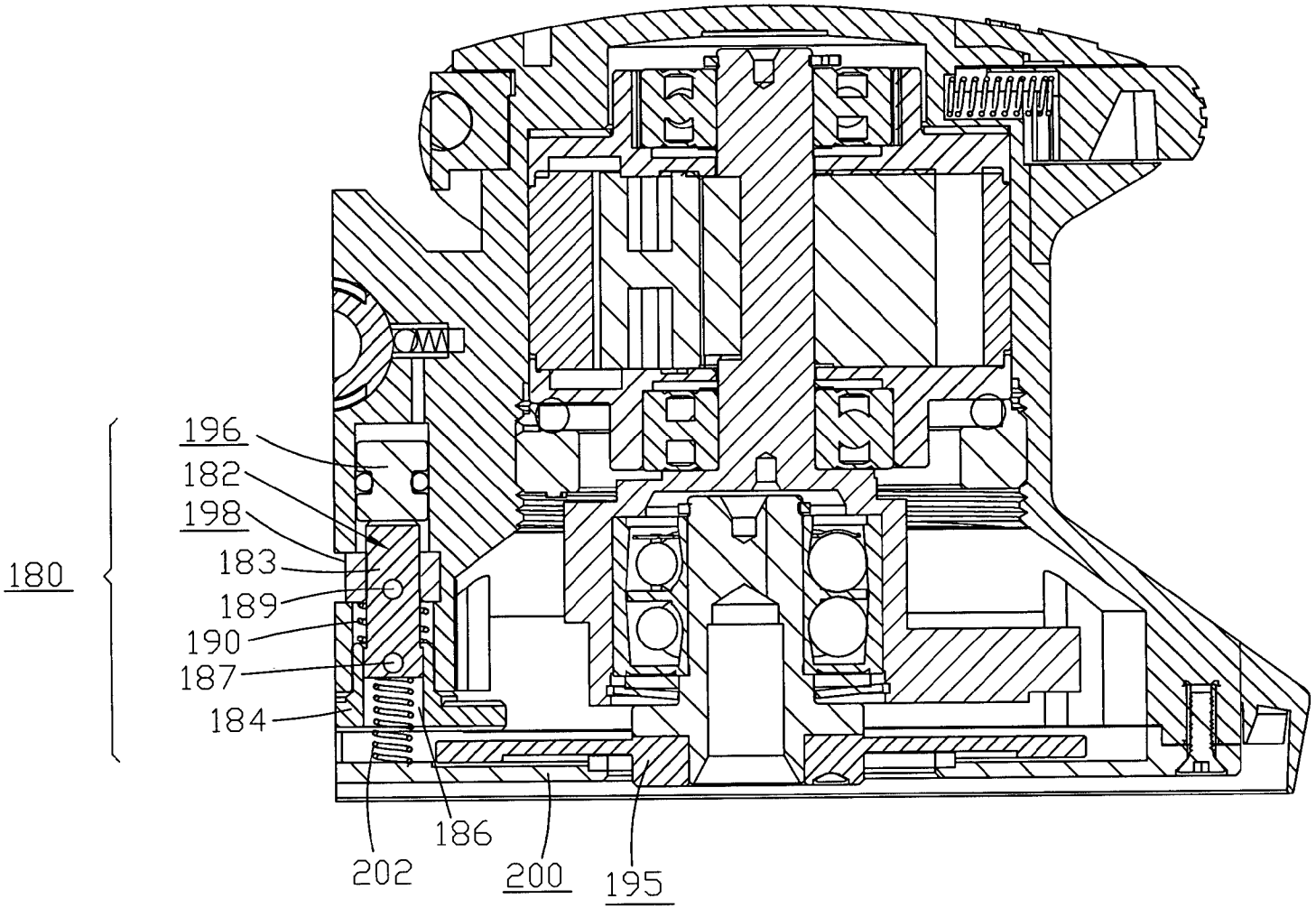
FIG. 20 is a sectional view of still another embodiment of the present invention.
Figure 23:
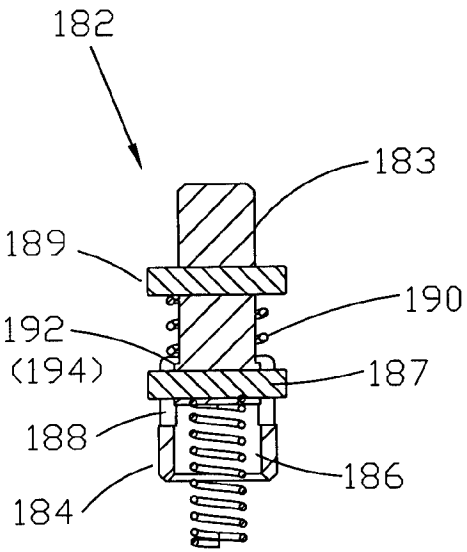
FIG. 23 is a sectional view taken along line 23—23 of FIG. 21.
Figure 22:
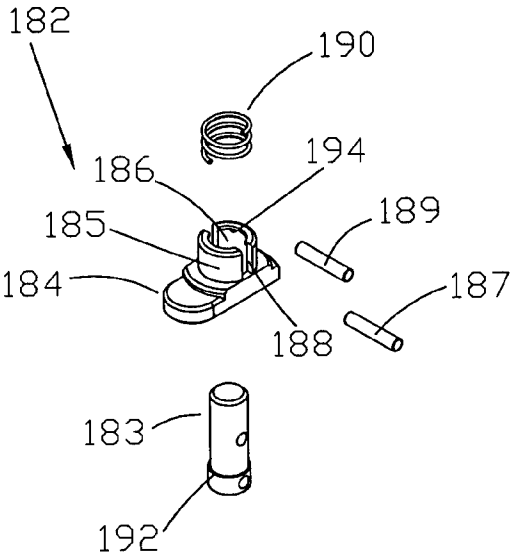
FIG. 22 is a perspective exploded view according to FIG. 21.
Figure 21:
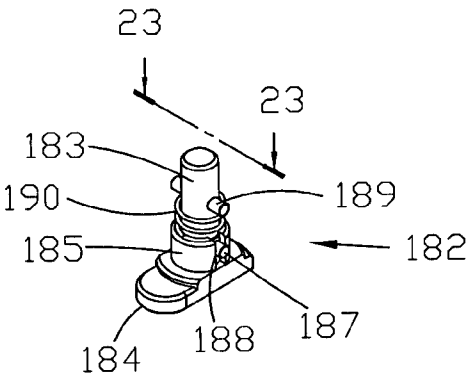
FIG. 21 is a perspective view of the engaging mechanism of FIG. 20.

FIG. 20 is a sectional view of still another embodiment of the present invention, which is an improvement of the first embodiment. FIGS. 21 to 23 show the engaging column 182 of the engaging mechanism 180 of this embodiment. The body 183 of the engaging column 182 and the engaging portion 184 are separate parts. A hollow cylindrical section 185 upward extends from top face of the engaging portion 184. The cylindrical section 185 is formed with an internal passage 186 passing through the engaging portion from top end to bottom end thereof. The bottom end of the body 183 of the engaging column is fitted in the passage 186, whereby the body 183 and the engaging portion are slidable relative to each other. An engaging pin 187 is disposed at the bottom end of the body of the engaging column and inserted in an insertion channel 188 formed on the cylindrical section, whereby the body of the engaging column can be moved within the passage 186 without rotation.

A second spring 190 is fitted on the body 183. Two ends of the spring 190 respectively abut against the cylindrical section and the pin 189 of the body of the engaging column, whereby in normal state, the body of the engaging column and the engaging portion are spaced from each other. The bottom face of the body of the engaging column is formed with a shoulder face 192 abutting against a shoulder face 194 of inner wall of the cylindrical section, whereby the body of the engaging column will not separate from the engaging portion.

FIG. 20 shows that the engaging mechanism 180 is positioned in a releasing position. At this time, the engaging mechanism does not clog the rotary member 195.

Figure 24:
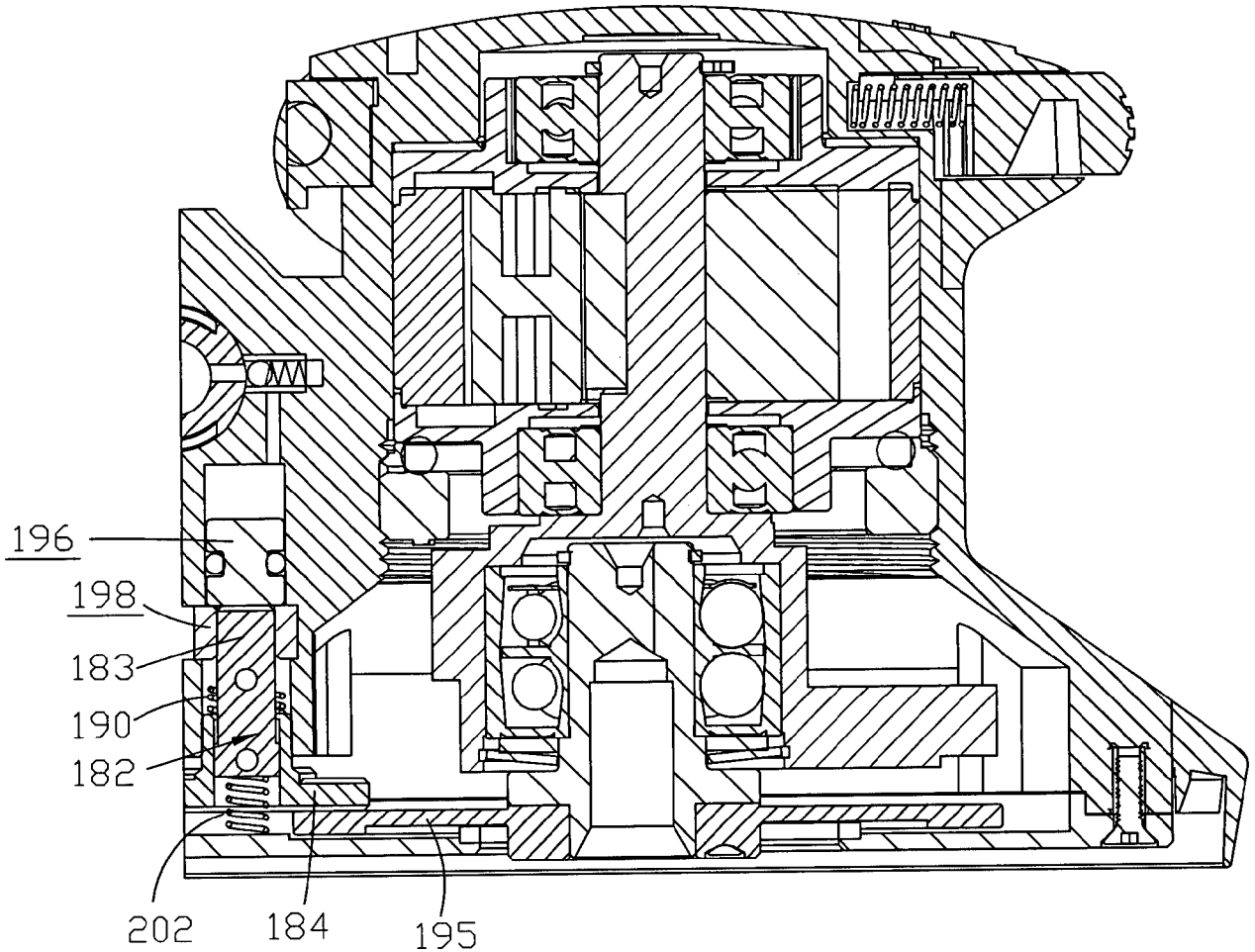
FIG. 24 shows that the engaging mechanism is positioned in the engaging position.
Figure 25:
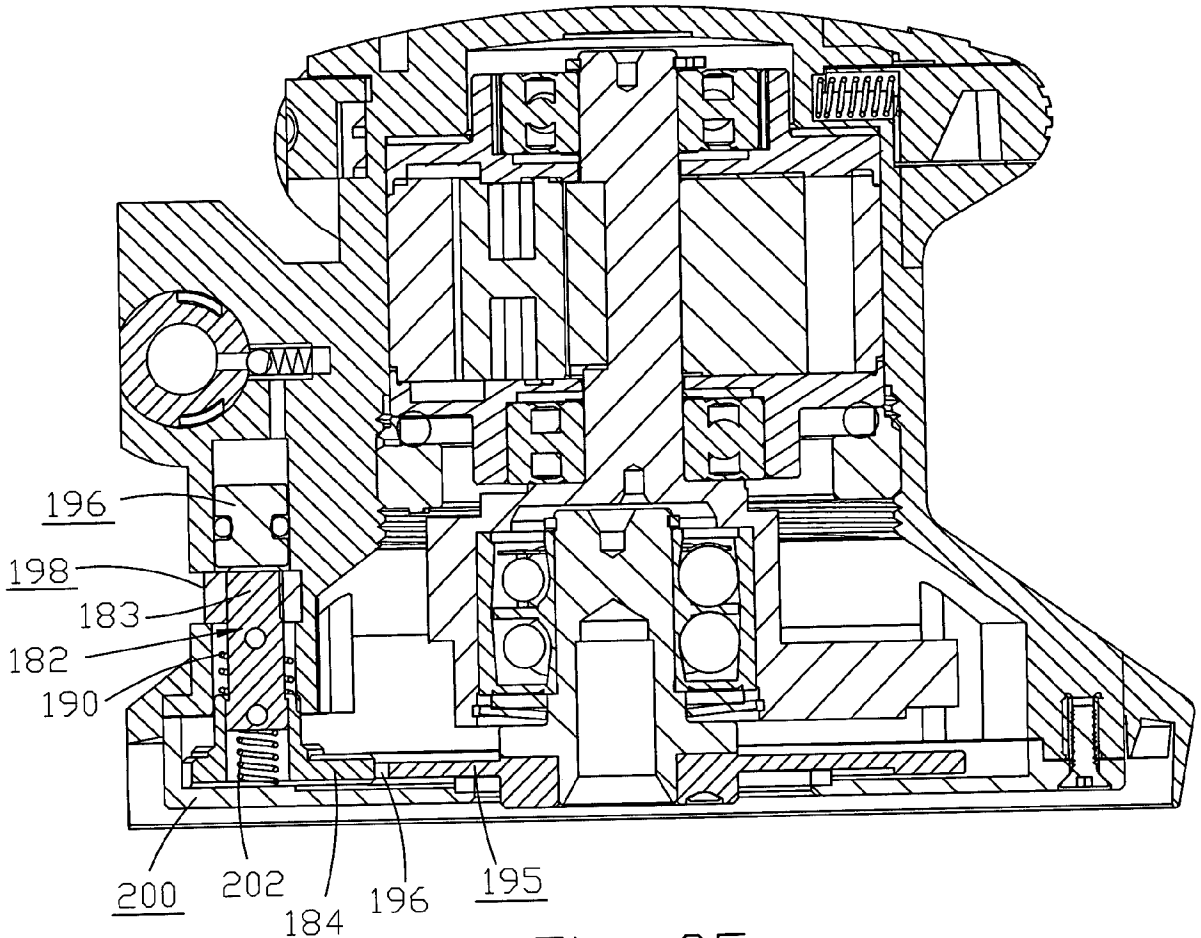
FIG. 25 shows that the engaging mechanism clogs the rotary member.

When replacing the grinding disc, this embodiment enables a user to directly move the engaging mechanism 180 to an engaging position without considering in which angular position the rotary member is positioned. As shown in FIG. 24, even if the engaging hole of the rotary member 195 is not positioned right under the engaging column 182, when the engaging mechanism is moved to the engaging position, the body 183 of the engaging column is moved downward and the engaging portion 184 is only slightly moved downward to contact with the top face of the rotary member 195. In this state, the distance between the body of the engaging column and the engaging portion is shortened and the second spring 190 is compressed between the two parts 184, 185. Thereafter, the grinding disc is manually turned to rotate the rotary member. When the engaging hole 196 of the rotary member 195 is moved to a position right under the engaging column as shown in FIG. 25, the engaging portion 184 is pushed by the second spring 190 to move downward into the engaging hole 196 for clogging the rotary member.

After the replacement of the grinding disc is completed, the engaging column is released from the action force applied to the engaging column by the piston 196 or shift button 198. The spring 202 disposed in the base seat 200 will lift and restore the engaging mechanism to the releasing position as shown in FIG. 20.

Figure 27:
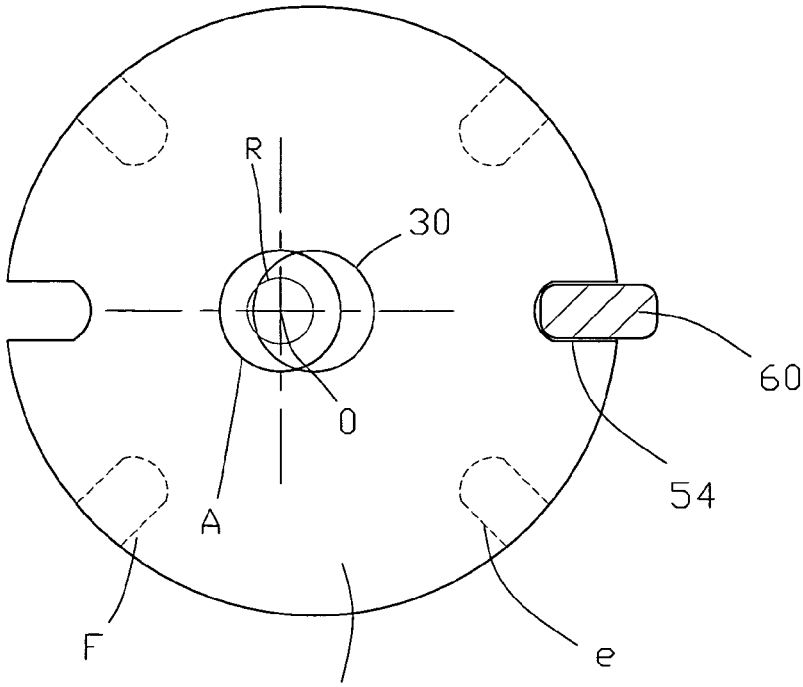
FIGS. 27 and 28 show the rotary shaft is stopped in different positions.
Figure 28:
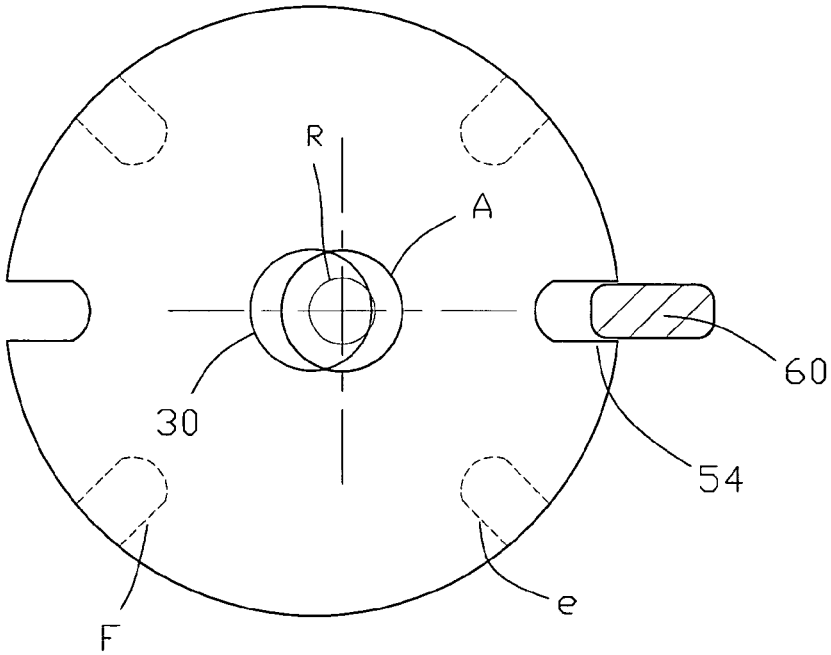

Please refer to FIGS. 27 and 28. After turning off the power of the grinder, the rotary shaft 30 may stop in any position of the track R. Also, the rotary shaft and the rotary member 50 may be positioned in any angular position. That is, the engaging section 54 of the rotary member 50 (86, 106, 139, 175 or 195) may be positioned in the position shown by phantom line e or f. At this time, a user can directly manually turn the rotary member 50 (which is rotated at where it is positioned). When the engaging section 54 is moved to the engaging mechanism 60 (90, 110, 130, or 180), the engaging mechanism 60 can be moved into the engaging section 54 to chuck the rotary member 50. Under such circumstance, the rotary shaft 30 cannot be moved and the user can replace the grinding disc.

In comparison to the aforementioned patents, the patents directly chuck the drive shafts, while the present invention chucks the driven shaft (rotary shaft 30), not the drive shaft A. The drive shaft is rotated about the origin point and is easy to chuck, while the position of the driven shaft is uncertain so that it is relatively uneasy to chuck the rotary shaft and the present invention solves the problem.

FIG. 27 shows that the rotary shaft is in a position the closest to the engaging mechanism 60, while FIG. 28 shows that the rotary shaft 30 is in a position the farthest to the engaging mechanism 60. Wherever the rotary shaft stops, the engaging section 54 of the rotary member 50 meets the engaging mechanism 60. Accordingly, no matter where the rotary shaft stops in the track R, the shaft is stopped by the engaging mechanism from rotating.

According to the above arrangement, it is known that by means of simple operation (turning the rotary button or shifting the shift button), the engaging member (that is, piston or engaging column) of the engaging mechanism can clog or release the rotary shaft for easily and conveniently replacing the grinding disc.

The above embodiments are only used to illustrate the present invention, not intended to limit the scope thereof.

What is claimed is:

1. A pneumatic grinder with easily replacing grinding disc, comprising:

a main body, a drive shaft is disposed in the main body;

a top end of a rotary shaft being eccentrically pivotally connected with the drive shaft and being driven by the drive shaft, whereby the rotary shaft revolving in a circular track, a bottom end of the rotary shaft being for mounting a grinding disc;

a rotary member fixedly connected with the bottom end of the rotary shaft and synchronously rotatable with the rotary shaft; the rotary shaft and the rotary member may stop in any position of the circular track; and an engaging mechanism movably mounted in the main body, when the engaging mechanism is moved to an engaging position, the engaging mechanism clogging the rotary member wherever the rotary shaft positioned in the track, when the engaging mechanism is moved to a releasing position, the engaging mechanism releasing the rotary member.

2. The grinder as claimed in claim 1, wherein at least one engaging section being formed on the rotary member; wherever the rotary shaft positioned in the track, the engaging mechanism meets the engaging section to clog the rotary member.

3. The grinder as claimed in claim 1, wherein:

a slide way being vertically disposed in the main body, a circumference of the main body being formed with a window communicating with the slide way;

the engaging mechanism including an engaging column and a shift button, the engaging column being disposed in the slide way and vertically movable along the slide way, the shift button through the window being connected with the engaging column, whereby by means of shifting the shift button, the engaging column can be driven to vertically move between the engaging position and the releasing position to clog the rotary member or release the rotary member.

4. The grinder as claimed in claim 3, wherein the engaging column is mounted in the slide way without angularly displacing, the shift button having a cylindrical button body and a shift section connected with the button body, the button body extending through the window to fit on the engaging column, the shift section being exposed to outer side of the main body, whereby by means of turning the shift button, the engaging column can be moved up or down.

5. The grinder as claimed in claim 4, wherein the engaging column has a transverse pin, a bottom face of the button body being formed with a cam section in contact with the pin; further comprising a resilient member for resiliently lifting the engaging column.

6. The grinder as claimed in claim 4, wherein the engaging column has a transverse pin, a top face of the button body being formed with a cam section in contact with the pin; further comprising a resilient member for resiliently pushing the engaging column downward.

7. The grinder as claimed in claim 5, wherein the slide way has a polygonal cross-section, the body of the engaging column having a polygonal section inserted in the slide way, the resilient member being disposed in the slide way.

8. The grinder as claimed in claim 3, wherein at least one engaging section is formed on the circumference of the rotary member, the bottom end of the engaging column engages with the engaging section of the rotary member.

9. The grinder as claimed in claim 8, wherein the bottom end of the engaging column being formed with an engaging portion for engaging with the engaging section of the rotary member; further comprising a base seat formed with a central through hole, a top face of the base seat being formed with a recess, the base seat being fixedly connected with the bottom end of the main body, the rotary member being positioned above the base seat, the engaging portion of the engaging column being vertically movably accommodated in the recess, the engaging portion being inserted in the recess, whereby the engaging column cannot rotate; a resilient member being disposed between the recess and the bottom end of the engaging column for resiliently lifting the engaging column.

10. The grinder as claimed in claim 9, wherein the engaging column has a column body and said engaging portion, the bottom end of the column body being unseparably fitted with top face of the engaging portion, whereby the column body and the engaging portion are vertically movable relative to each other, a second resilient member being disposed between the column body and the engaging portion for resiliently spacing the column body from the engaging portion.

11. The grinder as claimed in claim 10, wherein the top face of the engaging portion is formed with an inward extending passage, the bottom end of the column body being fitted in the passage.

12. A pneumatic grinder with easily replacing grinding disc, comprising:

a main body, a flow way being formed in the main body, whereby high-pressure air can flow into the flow way, a slide way being formed in the main body, one end of the slide way communicating with the flow way;

a rotary shaft disposed at a bottom end of the main body and drivable, a bottom end of the rotary shaft being for mounting a grinding disc;

an intake button disposed in the main body between the flow way and the slide way, the intake button being switchable between an unblocking position and a blocking position, whereby when the intake button is positioned in the unblocking position, the flow way communicates with the slide way, while when the intake button is positioned in the blocking position, the communication between the flow way and the slide way is interrupted;

an engaging mechanism including a piston and a resilient member, the piston being airtight and movably fitted in the slide way, one end of the piston extending out of the slide way, the resilient member being disposed between the slide way and the piston to resiliently push the piston, whereby when the piston is free from air pressure, the piston is pushed to a releasing position; and a rotary member fixedly connected with the bottom end of the rotary shaft and synchronously rotatable with the rotary shaft, whereby when the flow way communicates with the slide way, the high-pressure air goes into the slide way to drive the piston to move to a engaging position for clogging the rotary member.

13. The grinder as claimed in claim 12, wherein the main body is formed with a valve room, the flow way and one end of the slide way both communicating with the valve room, the intake button being pivotally disposed in the valve room.

14. The grinder as claimed in claim 12, wherein the intake button is formed with a conducting hole, whereby when the intake button is positioned in the unblocking position, the conducting hole communicates with the flow way with the slide way.

15. A pneumatic grinder with easily replacing grinding disc, comprising:

a main body, a flow way being formed in the main body, whereby high-pressure air can flow into the flow way, a slide way being vertically formed in the main body, a top end of the slide way communicating with the flow way, a window being formed on a circumference of the main body to communicate with the slide way;

a rotary shaft disposed at a bottom end of the main body and drivable, a bottom end of the rotary shaft being for mounting a grinding disc;

an intake button disposed in the main body between the flow way and the slide way, the intake button being switchable between an unblocking position and a blocking position, whereby when the intake button is positioned in the unblocking position, the flow way communicates with the slide way, while when the intake button is positioned in the blocking position, the communication between the flow way and the slide way is interrupted;

a rotary member fixedly connected with the bottom end of the rotary shaft and synchronously rotatable with the rotary shaft; and an engaging mechanism including a piston, an engaging column, a shift button and a resilient member, the piston being airtight and vertically movably fitted in the slide way, the engaging column being vertically movably disposed in the slide way under the piston, the shift button being through the window connected with the engaging column, when turning the shift button, the engaging column being driven to move, whereby when the engaging column being moved downward to an engaging position, the engaging column clogs the rotary member, the resilient member serving to resiliently push the engaging column, whereby in normal state, the engaging column tends to move upward to a releasing position; when turning the intake button to communicate the flow way with the slide way, the high-pressure air going into the slide way to drive the piston to move downward, whereby the engaging column being pushed by the piston to move downward to the engaging position.

16. The grinder as claimed in claim 15, wherein the engaging column is mounted in the slide way without angularly displacing, a pin being transversely disposed on the engaging column, the shift button having a cylindrical button body and a shift section connected with the button body, a cam section being formed on the bottom face of the button body, the button body extending through the window into the slide way to fit on the engaging column, the cam section contacting with the pin, the shift section being exposed to outer side of the main body, the shift button being horizontally rotatable to change angular position.

17. The grinder as claimed in claim 15, wherein at least one engaging section is formed on the circumference of the rotary member, the bottom end of the engaging column being formed with an engaging portion for engaging with the engaging section of the rotary member, the grinder further comprising an annular base seat formed with a central through hole, a top face of the base seat being formed with a recess, the base seat being fixedly connected with the bottom end of the main body, the rotary member being positioned above the base seat, the bottom end of the engaging column being inserted in the recess, whereby the engaging column cannot be rotated, the resilient member being disposed in the recess for pushing the bottom end of the engaging column.

18. The grinder as claimed in claim 17, wherein the engaging column has a column body and said engaging portion, the bottom end of the column body being unseparably fitted with top face of the engaging portion, whereby the column body and the engaging portion are vertically movable relative to each other, a second resilient member being disposed between the column body and the engaging portion for resiliently spacing the column body from the engaging portion.

19. The grinder as claimed in claim 18, wherein the top face of the engaging portion is formed with an inward extending passage, the bottom end of the column body being fitted in the passage.

20. A pneumatic grinder with easily replacing grinding disc, comprising:

a main body, a flow way being formed in the main body, whereby high-pressure air can flow into the flow way, a slide way being vertically formed in the main body, a top end of the slide way communicating with the flow way;

a rotary shaft disposed at a bottom end of the main body and drivable, a bottom end of the rotary shaft being for mounting a grinding disc;

an intake button disposed in the main body between the flow way and the slide way, the intake button being switchable between an unblocking position and a blocking position, whereby when the intake button is positioned in the unblocking position, the flow way communicates with the slide way, while when the intake button is positioned in the blocking position, the communication between the flow way and the slide way is interrupted;

a rotary member fixedly connected with the bottom end of the rotary shaft and synchronously rotatable with the rotary shaft; and an engaging mechanism including a piston, an engaging column and a resilient member, the piston being airtight and vertically movably fitted in the slide way, the engaging column being vertically movably disposed in the slide way under the piston; the resilient member being disposed between the slide way and the engaging column to resiliently push the engaging column, whereby when the piston is free from air pressure, the column and the piston are lifted by the resilient member; when turning the intake button to communicate the flow way with the slide way, the high-pressure air going into the slide way to drive the piston and the engaging column to move downward, the engaging column clogs the rotary member.

* * * * *